US011317690B2

(12) United States Patent
Osnowitz

(10) Patent No.: US 11,317,690 B2
(45) **Date of Patent: *May 3, 2022**

(54) CONVERTIBLE BAG

(71) Applicant: Rebecca Sax Osnowitz, Chicago, IL (US)

(72) Inventor: Rebecca Sax Osnowitz, Chicago, IL (US)

( * ) Notice: Subject to any disclaimer, the term of this patent is extended or adjusted under 35 U.S.C. 154(b) by 491 days.

This patent is subject to a terminal disclaimer.

(21) Appl. No.: 16/362,622

(22) Filed: Mar. 23, 2019

(65) Prior Publication Data

US 2019/0216194 A1 Jul. 18, 2019

Related U.S. Application Data

(63) Continuation of application No. 16/056,164, filed on Aug. 6, 2018, now Pat. No. 10,278,463.

(60) Provisional application No. 62/548,628, filed on Aug. 22, 2017.

(51) Int. Cl.

| | |
|---|---|
| ***A45C 1/02*** | (2006.01) |
| ***A45C 7/00*** | (2006.01) |
| ***B65D 33/16*** | (2006.01) |
| ***A45C 13/10*** | (2006.01) |
| *A45C 9/00* | (2006.01) |

(52) U.S. Cl.

CPC ..... *A45C 7/0077* (2013.01); *A45C 1/02* (2013.01); *A45C 7/0063* (2013.01); *A45C 13/103* (2013.01); *B65D 33/1658* (2013.01); *A45C 2007/0013* (2013.01); *A45C 2009/007* (2013.01)

(58) Field of Classification Search

CPC ..... B65D 33/1658; A45C 1/02; A45C 2007/0013; A45C 7/0077; A45C 2009/007; A45C 13/103

USPC ..... 150/100; 190/107

See application file for complete search history.

(56) References Cited

U.S. PATENT DOCUMENTS

| | | | | |
|---|---|---|---|---|
| 920,852 | A * | 5/1909 | Flanagan | A45C 7/0063 |
| 2,018,809 | A | 10/1935 | Rodgers | |
| 2,440,138 | A | 4/1948 | Benenfeld | |
| 2,457,422 | A | 12/1948 | Warner | |
| 2,516,551 | A | 7/1950 | Chenoweth | |

(Continued)

FOREIGN PATENT DOCUMENTS

| | | | |
|---|---|---|---|
| GB | 278892 | A | 10/1927 |
| GB | 1 459 128 | A | 12/1976 |

OTHER PUBLICATIONS

WikiHow, "How to Sew a French Seam" article [online]. Cited in PCT/US2018/045408 search report dated Oct. 22, 2018 with the following information Dec. 4, 2013 [retrieved on Sep. 26, 2018]. Retrieved from the internet: <URL: https://web.archive.org/web/20131204231107/https://www.wikihow.com/Sew-a-French-Seam>, entire document.

(Continued)

*Primary Examiner* — Sue A Weaver

(74) *Attorney, Agent, or Firm* — Nixon Peabody LLP

(57) ABSTRACT

A bag includes a first sidewall, a second opposing sidewall, and a foldable base. The foldable base is coupled to the first sidewall and the second side wall. The foldable base includes a first rigid panel coupled to a second rigid panel such that the foldable base is configured to fold from a generally flat configuration to a folded configuration, thereby converting the bag from an expanded configuration to a collapsed configuration.

20 Claims, 18 Drawing Sheets

(56) References Cited

U.S. PATENT DOCUMENTS

| | | | | |
|---|---|---|---|---|
| 3,305,052 | A | 2/1967 | Kish | |
| 3,443,671 | A | 5/1969 | Dyke | |
| 6,161,665 | A | 12/2000 | Hoover | |
| 7,621,305 | B2 | 11/2009 | Cho | |
| 9,038,679 | B2 | 5/2015 | Marquez-Bottome | |
| 10,278,463 | B2 * | 5/2019 | Osnowitz ..... | A45C 7/0063 |
| 2011/0000590 | A1 | 1/2011 | Welch | |
| 2013/0075284 | A1 | 3/2013 | Yee | |
| 2017/0020252 | A1 | 1/2017 | Chin | |

OTHER PUBLICATIONS

International Search Report and Written Opinion of the International Searching Authority in International Patent Application No. PCT/US2018/045408, dated Oct. 22, 2018 (11 pages).

* cited by examiner

CONVERTIBLE BAG

CROSS-REFERENCE TO RELATED APPLICATIONS

This application is a continuation of U.S. patent application Ser. No. 16/056,164, filed on Aug. 6, 2018, now allowed, which claims the benefit of and priority to U.S. Provisional Patent Application No. 62/548,628, filed on Aug. 22, 2017, each of which is hereby incorporated by reference herein in its entirety.

FIELD OF THE PRESENT DISCLOSURE

The present disclosure relates to bags, more particularly, to bags convertible between a first configuration and a second configuration.

BACKGROUND

Bags, such as, purses, are known for being used to carry a wide variety of items depending on the needs of the user at the time. To accommodate such a variety of items, some bags are very large. However, when only a few select items are needed, smaller bags (e.g., a clutch-type purse) are used. Thus, a typical user of bags needs to have many different bags to accommodate varying amounts of items for different situations.

The present disclosure is directed to solving these problems and addressing other needs.

SUMMARY OF THE PRESENT DISCLOSURE

According to some implementations of the present disclosure a bag convertible between a first configuration and a second configuration includes a first sidewall, a second sidewall, a foldable base, a first endwall, and a second endwall. The first sidewall has a first opening therein providing access to a first side pocket. The second opposing sidewall has a second opening therein providing access to a second side pocket. The foldable base is coupled to the first sidewall and the second side wall. The foldable base includes a first rigid panel coupled to a second rigid panel such that the foldable base is configured to fold from a generally flat configuration to a folded configuration, thereby converting the bag from the first configuration to the second configuration. The first endwall is coupled to (i) the foldable base via a first double stitch, (ii) the first side wall via a second double stitch, and (iii) the second sidewall via a third double stitch. The second endwall is coupled to (i) the foldable base via a fourth double stitch, (ii) the first side wall via a fifth double stitch, and (iii) the second sidewall via a sixth double stitch.

According to some implementations of the present disclosure a bag includes a first sidewall, a second opposing sidewall, and a foldable base. The foldable base is coupled to the first sidewall and the second side wall. The foldable base includes a first rigid panel coupled to a second rigid panel such that the foldable base is configured to fold from a generally flat configuration to a folded configuration, thereby converting the bag from an expanded configuration to a collapsed configuration.

According to some implementations of the present disclosure a bag convertible between an expanded configuration and a collapsed configuration includes a first sidewall, a second sidewall, a foldable base, a first endwall, and a second endwall. The first sidewall has a first opening therein providing access to a first side pocket. The second opposing sidewall has a second opening therein providing access to a second side pocket. The foldable base is coupled to the first sidewall and the second side wall. The foldable base includes a first rigid panel with one or more first magnets coupled thereto, a second rigid panel with one or more second magnets coupled thereto, and a flexible strip coupling the first and second rigid panels together such that the foldable base is configured to fold in a first direction from a generally flat configuration to a folded configuration but not fold in a second opposing direction from the generally flat configuration, thereby converting the bag from the first configuration to the second configuration. The one or more first magnets and the one or more second magnets are configured to aid in maintaining the foldable base in the folded configuration and the bag in the second configuration. The first endwall is coupled to (i) the foldable base via a first double stitch, (ii) the first side wall via a second double stitch, and (iii) the second sidewall via a third double stitch. The second endwall is coupled to (i) the foldable base via a fourth double stitch, (ii) the first side wall via a fifth double stitch, and (iii) the second sidewall via a sixth double stitch, wherein the first, second, third, fourth, fifth, and sixth double stitches each includes a hidden interior stitch and an exposed exterior stitch.

According to some implementations of the present disclosure a bag, that is convertible between a first configuration and a second configuration, includes a first side, a second opposing side, and a bi-folding base. The first side has a first opening therein providing access to a first side pocket. The second opposing side has a second opening therein providing access to a second side pocket. The bi-folding base has a first rigid panel coupled to a second rigid panel such that the bi-folding base is configured to fold from a first, generally flat position to a second, folded position, thereby converting the bag from the first configuration to the second configuration.

According to some implementations of the present disclosure a bag, that is convertible between a first configuration and a second configuration, includes a first side, a second opposing side, a bi-folding base, and a fastener. The first side has a first opening therein providing access to a first side pocket. A length of the first opening is at least 80 percent of a height of the bag in the second configuration. A width of the first side pocket is at least 80 percent of a width of the bag. The second opposing side has a second opening therein providing access to a second side pocket. A length of the second opening is at least 80 percent of the height of the bag in the second configuration. A width of the second side pocket is at least 80 percent of the width of the bag. The bi-folding base has a first rigid panel coupled to a second rigid panel such that the bi-folding base is configured to fold from a first, generally flat position to a second, folded position, thereby converting the bag from the first configuration to the second configuration and resulting in the height of the bag being increased, a depth of the bag being decreased, and the width of the bag being maintained. The fastener is configured to aid in maintaining the bi-folding base in the second, folded position and the bag in the second configuration.

According to some implementations of the present disclosure a storage bag includes a pair of sidewalls and a foldable base. The pair of sidewalls each has an elongated pocket overlaying a majority portion of each respective sidewall. The foldable base is between the sidewalls at one end of the storage bag with an opening at the other end of the storage bag leading to an interior cavity within the storage bag. Outside surface portions of the foldable base abut one another in a folded configuration and are generally coplanar with one another in an expanded configuration such that converting the storage bag from the folded configuration to the expanded configuration causes the interior cavity to expand to reveal a volumetric cavity defined by the sidewalls and the foldable base. Converting the storage bag from the expanded configuration to the folded configuration collapses the interior volume by elongating an overall height of the storage bag as the outside surface portions of the foldable base are urged toward one another.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
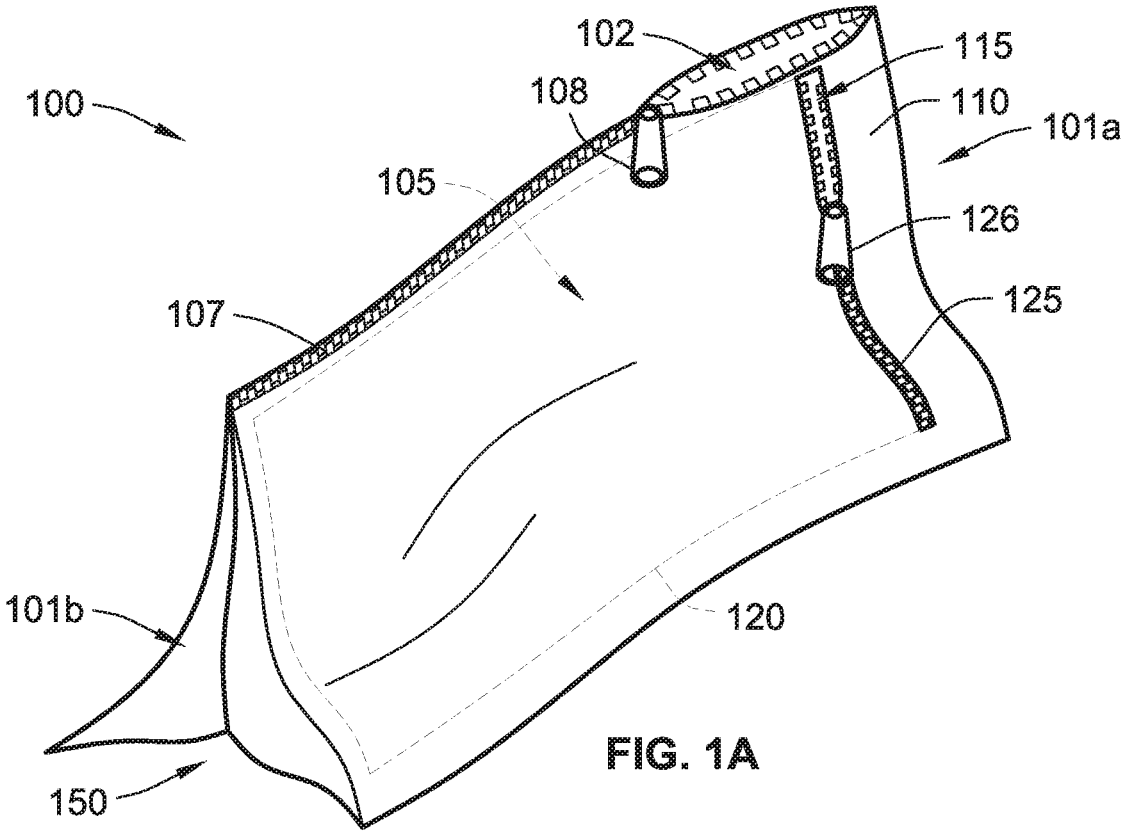
FIG. 1A is a first side perspective view of a convertible bag in a first configuration according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Figure 1B:
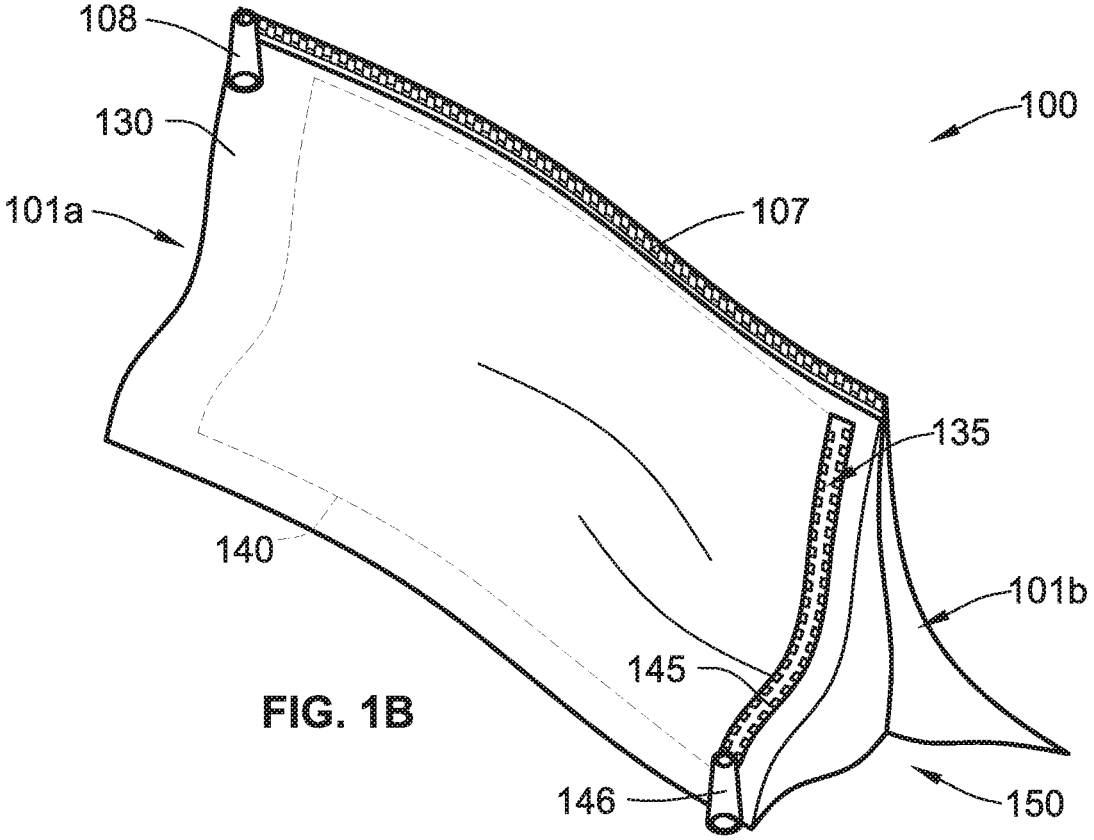
FIG. 1B is a second side perspective view of the convertible bag of FIG. 1A.
Figure 1C:
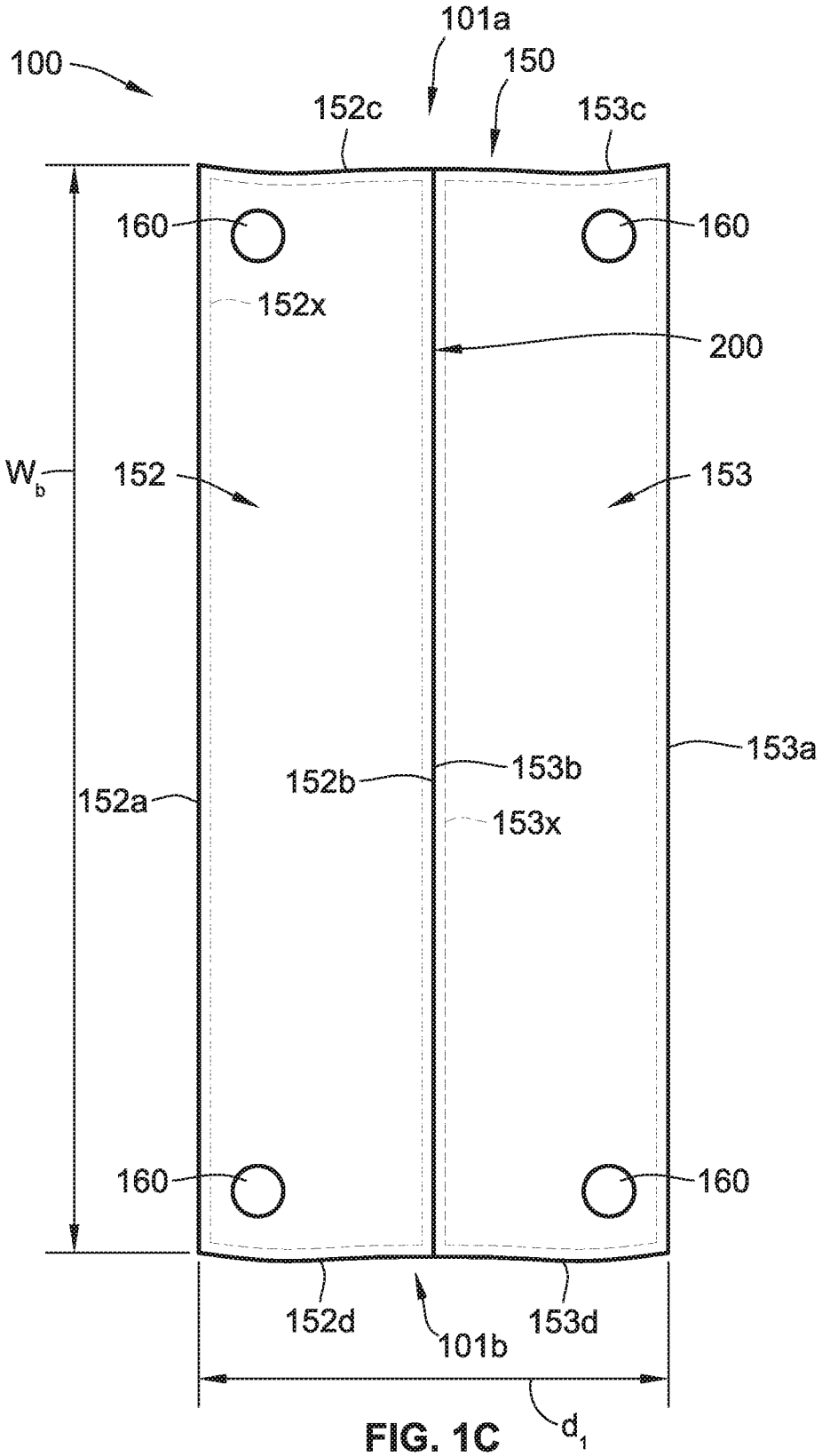
FIG. 1C is a bottom view of the convertible bag of FIG. 1A.

Referring generally to FIGS. 1A-1C, a bag 100 includes a first side 110, a second opposing side 130, and a bi-folding base 150. The bag 100 can have any size, any shape, any color, and be made from any material or combination of materials. For example, the bag 100 can be made of leather, cardboard, plastic, fabric, nylon, metal, etc., or any combination thereof. Further, the bag 100 can be made of any number of parts or panels or sheets of material (e.g., one sheet of material, two sheets of material, five sheets of material, etc.) that are coupled together to form the bag 100.

As best shown in FIG. 1A, the first side 110 of the bag 100 has an absolute width and an absolute height. By "absolute width" and "absolute height" it is meant that the width and height of the first side 110 are measured with the first side 110 generally laid flat and planar (e.g., not bent in a three-dimensional space as the first side 110 is when assembled into the bag 100 as shown in FIGS. 1A-1B). The absolute width of the first side 100 can be any length, such as, for example, about two inches, about three inches, about four inches, about five inches, about six inches, about seven inches, about eight inches, about nine inches, about ten inches, about twenty inches, about fifty inches, about one hundred inches, etc., and/or any length in between, greater, or less. Similarly, the absolute height of the first side 100 can be any length, such as, for example, about two inches, about three inches, about four inches, about five inches, about six inches, about seven inches, about eight inches, about nine inches, about ten inches, about twenty inches, about fifty inches, about one hundred inches, etc., and/or any length in between, greater, or less.

The first side 110 of the bag 100 has a first opening 115 therein (FIG. 1A). As shown, the first opening 115 is a slit or slot formed in the first side 110. The first opening 115 can be made, for example, by cutting the first side 110. As shown, the first opening 115 has a generally straight line profile when the first opening 115 is at rest. By "at rest" it is meant that the first side 110 is generally laid flat and planar and the first opening 115 is not being pulled or opened. Alternatively to the first opening 115 having a generally straight line profile, the first opening 115 can have any shape profile (e.g., "s" shaped profile, curved shaped profile, etc., or any combination thereof).

The first opening 115 can have any length. The length of the first opening 115 can be between about five percent and about ninety-five percent of the absolute height of the first side 110. In some implementations, the length of the first opening 115 is between about fifty percent and about ninety-five percent of the absolute height of the first side 110. In some implementations, the length of the first opening 115 is between about seventy-five percent and about ninety percent of the absolute height of the first side 110. In some implementations, the length of the first opening 115 is at least eighty percent of the absolute height of the first side 110. In some implementations, the length of the first opening 115 is greater than a height of the bag 100 in the first configuration (FIGS. 1A and 1B).

As best shown in FIG. 1A, the first opening 115 provides access from the outside of the bag 100 (as opposed to from the inside of the bag 100) into a first side pocket 120. The first side pocket 120 is separate and distinct from the first side 110, but the first side pocket 120 is coupled to the first side 110 such that the first opening 115 in the first side 110 aligns with a corresponding opening in the first side pocket 120 such that one or more items (e.g., flip-flop, sandal, etc.) can be placed into the first side pocket 120 via the first opening 115. In some implementations, the first side pocket 120 is only accessible from the outside of the bag 100. Alternatively, the first side pocket 120 can also be accessed from inside the bag 100 or only from inside the bag 100.

In some implementations, the first side pocket 120 is formed by two pieces of material (e.g., two sides of the pocket) coupled together on all sides except for one side, or a portion of one side, that forms the opening into the first side pocket 120. The first side pocket 120 can be made from any material or combination of materials, such as, for example, leather, cardboard, plastic, fabric, nylon, metal, etc., or any combination thereof. As shown, the first side pocket 120 has a generally rectangular shape, but the first side pocket 120 can have any shape (e.g., generally square, generally triangular, generally oval, generally circular, generally polygonal, etc. or any combination thereof). In some implementations, instead of the first pocket 120 being formed by two pieces of material as described above, the first side pocket 120 is formed by one piece of material coupled directly to the first side 110 to form the first side pocket 120 therebetween.

The first side pocket 120 has an absolute width and an absolute height. By "absolute width" and "absolute height" it is meant that the width and height of the first side pocket 120 are measured with the first side pocket 120 generally laid flat and planar (e.g., not bent in a three-dimensional space and not opened, with both sides of the first side pocket 120 completely overlapping each other).

The absolute width of the first side pocket 120 can be any length, such as, for example, the absolute width of the first side pocket 120 can be between about five percent and about ninety-five percent of the absolute width of the first side 110. In some implementations, the absolute width of the first side pocket 120 is between about fifty percent and about ninety-five percent of the absolute width of the first side 110. In some implementations, the absolute width of the first side pocket 120 is between about seventy-five percent and about ninety percent of the absolute width of the first side 110. In some implementations, the absolute width of the first side pocket 120 is at least eighty percent of the absolute width of the first side 110.

The absolute height of the first side pocket 120 can be any length, such as, for example, the absolute height of the first side pocket 120 can be between about five percent and about ninety-five percent of the absolute height of the first side 110. In some implementations, the absolute height of the first side pocket 120 is between about fifty percent and about ninety-five percent of the absolute height of the first side 110. In some implementations, the absolute height of the first side pocket 120 is between about seventy-five percent and about ninety percent of the absolute height of the first side 110. In some implementations, the absolute height of the first side pocket 120 is at least eighty percent of the absolute height of the first side 110. The absolute height of the first side pocket 120 can be about equal to the length of the first opening 115, greater than the length of the first opening 115, or less than the length of the first opening 115.

As shown in FIG. 1A, a first zipper track 125 is coupled to the first opening 115 such that the first opening 115 can be opened and closed via a first zipper pull 126. Alternatively, the first opening 115 can be opened and closed via any other method (e.g., one or more buttons, one or more snaps, one or more clasps, one or more buckles, one or more magnets, etc., or any combination thereof). Further, in some implementations, the first opening 115 can remain open without any type of mechanism to close it.

As best shown in FIG. 1B, the second side 130 of the bag 100 has an absolute width and an absolute height. By "absolute width" and "absolute height" it is meant that the width and height of the second side 130 are measured with the second side 130 generally laid flat and planar (e.g., not bent in a three-dimensional space as the second side 130 is when assembled into the bag 100 as shown in FIGS. 1A-1B). The absolute width and the absolute height of the second side 130 can be the same as, or similar to, the absolute width and the absolute height of the first side 110 described above.

The second side 130 of the bag 100 has a second opening 135 therein (FIG. 1B) that is the same as, or similar to, the first opening 115. As best shown in FIG. 1B, the second opening 135 provides access from the outside of the bag 100 (as opposed to from the inside of the bag 100) into a second side pocket 140. The second side pocket 140 is the same as, or similar to, the first side pocket 120. Further, the second side pocket 140 is separate and distinct from the first side pocket 120. The second side pocket 140 is separate and distinct from the second side 130, but the second side pocket 140 is coupled to the second side 130 such that the second opening 135 in the second side 130 aligns with a corresponding opening in the second side pocket 140 such that one or more items (e.g., flip-flop, sandal, etc.) can be placed into the second side pocket 140 via the second opening 135. In some implementations, the second side pocket 140 is only accessible from the outside of the bag 100. Alternatively, the second side pocket 140 can also be accessed from inside the bag 100 or only from inside the bag 100. In some implementations, the length of the second opening 135 is greater than a height of the bag 100 in the first configuration (FIGS. 1A and 1B).

The second side pocket 140 has an absolute width and an absolute height. By "absolute width" and "absolute height" it is meant that the width and height of the second side pocket 140 are measured with the second side pocket 140 generally laid flat and planar (e.g., not bent in a three-dimensional space and not opened, with both sides of the second side pocket 140 completely overlapping each other). The absolute width and the absolute height of the second side pocket 140 can be the same as, or similar to, the absolute width and the absolute height of the first side pocket 120 described above.

As shown in FIG. 1B, a second zipper track 145 is coupled to the second opening 135 such that the second opening 135 can be opened and closed via a second zipper pull 146. Alternatively, the second opening 135 can be opened and closed via any other method (e.g., one or more buttons, one or more snaps, one or more clasps, one or more buckles, one or more magnets, etc., or any combination thereof). Further, in some implementations, the second opening 135 can remain open without any type of mechanism to close it.

Referring to FIGS. 1A and 1B, the first opening 115 is adjacent to (e.g., closer to) a first end 101*a* of the bag 100 and the second opening 135 is adjacent to (e.g., closer to) a second opposing end 101*b* of the bag 100. As such, a user of the bag 100 can hold the bag 100 with one hand (e.g., left hand) and operate the first zipper pull 126 with the other hand (e.g., right hand) and then rotate the bag 180 degrees and also hold the bag 100 with the same hand (e.g., left hand) and operate the second zipper pull 146 with the same hand (e.g., right hand). Alternatively, the first opening 115 and the second opening 135 can both be adjacent to the same end of the bag 100 (e.g., both adjacent to the first end 101*a* or both adjacent to the second opposing end 101*b*).

The first side 110 and the second side 130 of the bag 100 generally come together at the top or upper portion of the bag 100 to form a main opening 102 of the bag 100. As shown, the main opening 102 has a generally straight line profile, similar to the straight line profile of the first opening 115 and the second opening 135. Alternatively, the main opening 102 can have any shape profile (e.g., "s" shaped profile, curved shaped profile, etc., or any combination thereof).

The main opening 102 can have any length. The length of the main opening 102 can be between about five percent and about one hundred percent of the width, $W_b$, of the bag 100, which is shown in FIG. 1C. In some implementations, the length of the main opening 102 is between about fifty percent and about one hundred percent of the width, $W_b$, of the bag 100. In some implementations, the length of the main opening 102 is between about seventy-five percent and about one hundred percent of the width, $W_b$, of the bag 100. In some implementations, the length of the main opening 102 is at least eighty percent of the width, $W_b$, of the bag 100.

As shown in FIG. 1A, the main opening 102 provides access from the outside of the bag 100 into an interior cavity 105 of the bag 100. The interior cavity 105 is separate and distinct from the first side pocket 120 and from the second side pocket 140, but the first side pocket 120 and the second side pocket 140 are positioned within the interior cavity 105 of the bag 100. The main opening 102 can be opened by a user such that one or more items (e.g., a pair of shoes, a pair of high heels, etc.) can be placed into the interior cavity 105 via the main opening 102.

A main zipper track 107 is coupled to the main opening 102 such that the main opening 102 can be opened and closed via a main zipper pull 108. Alternatively, the main opening 102 can be opened and closed via any other method (e.g., one or more buttons, one or more snaps, one or more clasps, one or more buckles, one or more magnets, etc., or any combination thereof). Further, in some implementations, the main opening 102 can remain open without any type of mechanism to close it.

The first side 110 and the second side 130 are coupled together at the ends 101*a,b* of the bag 100. In some implementations, the first end 101*a* is formed by a portion of the first side 110 and/or a portion of the second side 130. Similarly, in some implementations, the second end 101*b* is formed by a portion of the first side 110 and/or a portion of the second side 130. Alternatively, the first end 101*a* is a separate and distinct piece or pieces of material from the first side 110 and from the second side 130 and the second end 101*b* is a separate and distinct piece or pieces of material from the first side 110 and from the second side 130.

Referring to FIG. 1C, the bi-folding base 150 of the bag 100 is shown in a generally flat or planar position or configuration. The bi-folding base 150 is generally formed into two equal halves that are coupled together and foldable about a fold line or a center line 200 of the bag 100. The bi-folding base 150 can be made of leather, cardboard, plastic, fabric, nylon, metal, etc., or any combination thereof. In some implementations, the bi-folding base 150 includes a first rigid panel 152 and a second rigid panel 153. Each of the rigid panels 152, 153 includes a rigid sheet of material, such as, for example, a metal sheet, a plastic sheet, a sheet of cardboard, etc. or a combination thereof. In some implementations, each of the rigid sheets of material is covered or wrapped with a fabric or leather, or the like, to form the first rigid panel 152 and the second rigid panel 153 that collectively form the bi-folding base 150. As shown in FIG. 1C, the first rigid panel 152 includes a first rigid sheet 152*x* wrapped and/or covered by a first piece(s) of material 152*y* and the second rigid panel 153 includes a second rigid sheet 153*x* wrapped and/or covered by a second piece(s) of material 153*y*.

The first rigid panel 152 has a pair of long edges 152*a,b* and a pair of short edges 152*c,d* and the second rigid panel 152 has a pair of long edges 153*a,b* and a pair of short edges 153*c,d*. Generally referring to FIGS. 1A-1C, the first long edge 152*a* of the first rigid panel 152 is coupled to the first side 110 and both of the short edges 152*c,d* of the first rigid panel 152 are also coupled to the first side 110 (e.g., via a portion of the first end 101*a* and via a portion of the second end 101*b*). Similarly, the first long edge 153*a* of the second rigid panel 153 is coupled to the second side 130 and both of the short edges 153*c,d* of the second rigid panel 153 are also coupled to the second side 130 (e.g., via a portion of the first end 101*a* and via a portion of the second end 101*b*).

As shown in FIG. 1C, the second long edge 152*b* of the first rigid panel 152 is coupled to the second long edge 153*b* of the second rigid panel 153 at the fold line 200. In some implementations, the connection or joint between the first and second rigid panels 152, 153 aids in prevent movement of the bi-folding base 150 in a first direction, but not in a second direction. The connection or joint may include stitching and/or other elements (e.g., biasing elements) that aid in the prevention of movement of the bi-folding base 150 in a particular direction.

In some implementations, the bi-folding base 150 is biased into the planar position by, for example, a biasing element. The biasing element can include, for example, a torsion spring, a leaf spring, a coil spring, etc. or any combination thereof. In some implementations, the biasing element includes a torsion spring that is at least partially between the first rigid panel 152 and the second rigid panel 153.

In some implementations, the bi-folding base 150 includes one or more fasteners 160. The fasteners 160 may also function as feet for the bag 100 (e.g., when the bag 100 is placed on a table or desk in the expanded or first configuration). As shown in FIG. 1C, the bi-folding base 150 includes four fasteners 160, although any number of fasteners can be included on the bi-folding base 150 (e.g., one, two, three, four, eight, ten, twenty, etc.). As is explained in further detail below, the fasteners 160 aid in maintaining the bag 100 in a folded position or configuration (second configuration). Each of the fasteners 160 can include a magnet, a ferromagnetic element, a clasp, a buckle, a button, a snap, a strap, hook and loop pads, a zipper track and zipper pull, or any combination thereof.

Figure 2A:
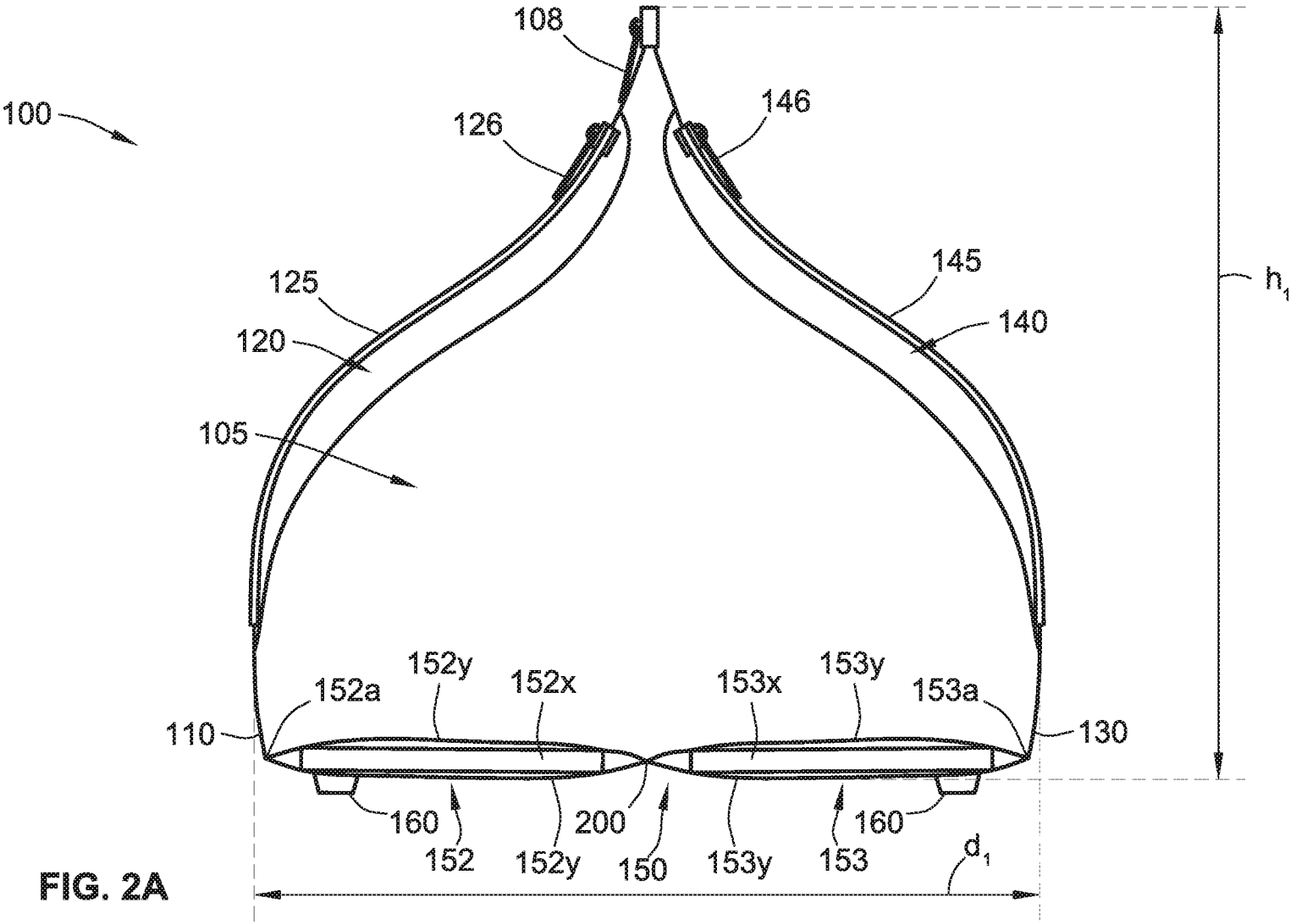
FIG. 2A is a cross-sectional end view of the convertible bag of FIG. 1A.
Figure 2B:
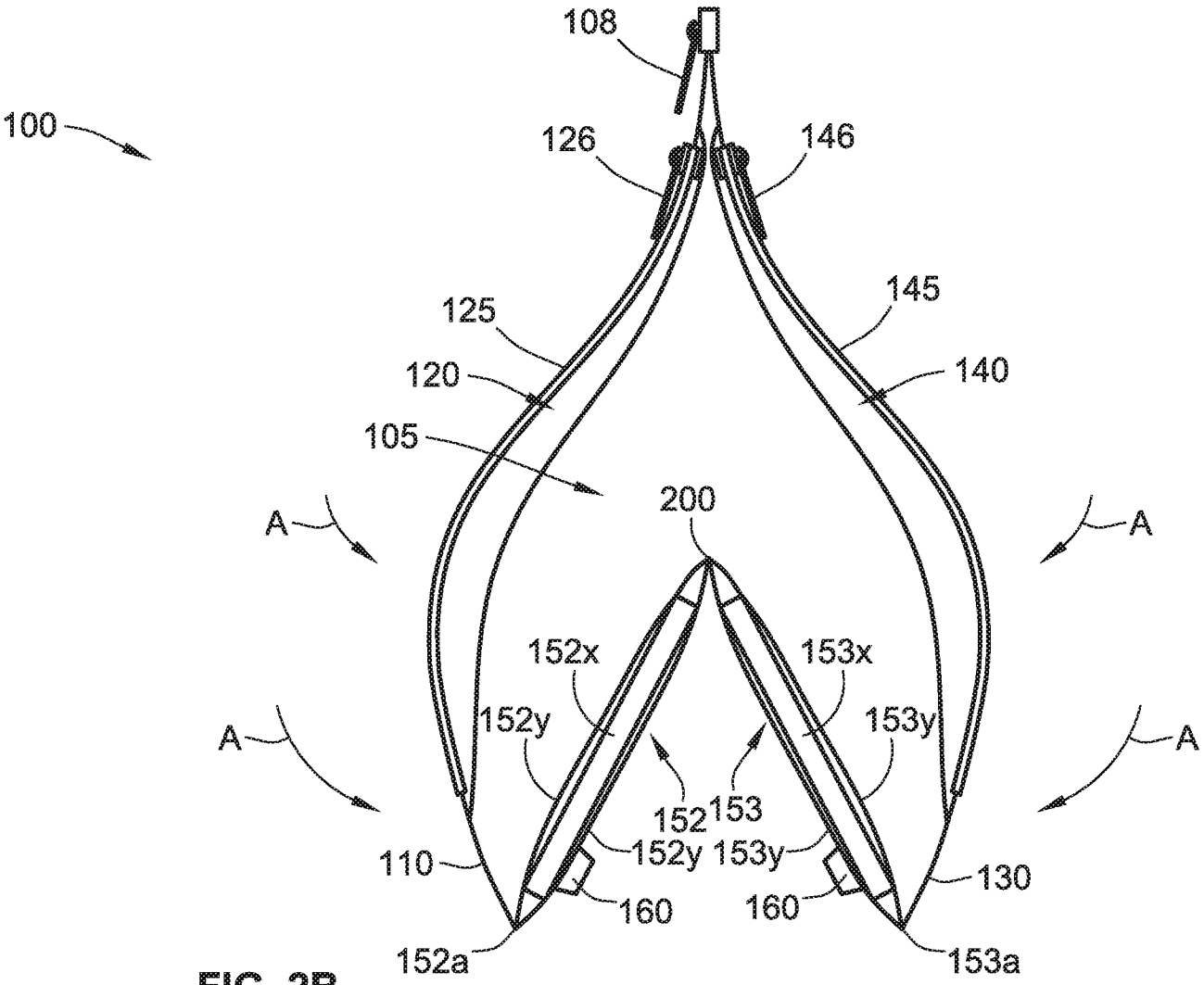
FIG. 2B is a cross-sectional end view of the convertible bag of FIG. 1A partially converted from the first configuration of FIG. 1A into a second configuration according to some implementations of the present disclosure.
Figure 2C:
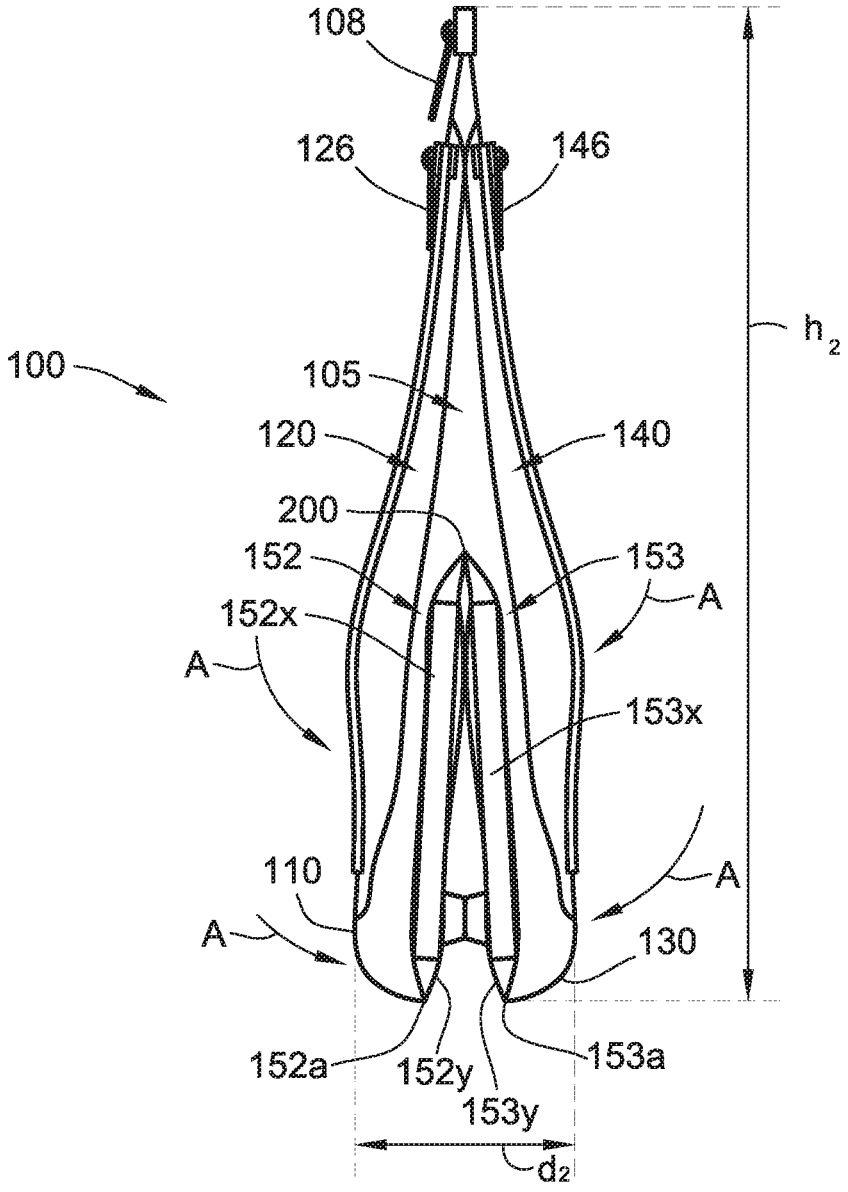
FIG. 2C is a cross-sectional end view of the convertible bag of FIG. 1A fully converted from the first configuration of FIG. 1A into the second configuration.

Now referring to FIGS. 2A-2C, a method of converting the bag 100 from a first configuration to a second configuration is illustrated. As shown in FIG. 2A, the bag 100 is in the first configuration or an expanded, relatively larger configuration. As shown in FIG. 2C, the bag 100 is in the second configuration or a folded, relatively smaller configuration.

In the first configuration (FIG. 2A), the bi-folding base 150 is in its generally flat or planar position. In the second configuration (FIG. 2C), the bi-folding base 150 is in its generally folded or bent position such that the first rigid panel 152 and the second rigid panel 153 at least partially abut one another (e.g., a portion of the fabric or material wrapped about the first rigid sheet 152*x* touches a corresponding portion of the fabric or material wrapped about the second rigid sheet 153*x*). Further, in the first configuration (FIG. 2A), the interior cavity 105 of the bag 100 is relatively large and ready to receive one or more relatively larger items therein (e.g., a pair of shoes or high heels, etc.). Whereas in the second configuration (FIG. 2C), the interior cavity 105 of the bag 100 is relatively small and only able to receive relatively smaller items therein (e.g., credit cards, lipstick, mints, etc., or any combination thereof). Put another way, in some implementations, when the bag 100 is in the first configuration, the interior cavity 105 of the bag 100 has a first volume and when the bag 100 is in the second configuration, the interior cavity 105 of the bag 100 has a second volume that is less than the first volume. Of course, the volume of the interior cavity 105 can be impacted (e.g., made smaller) by including one or more items within the first side pocket 120 and/or within the second side pocket 140, which would encroach into the interior cavity 105 resulting in a relatively smaller interior cavity 105.

In some implementations, the first volume is at least two times greater than the second volume. In some implementations, the first volume is at least three times greater than the second volume. In some implementations, the first volume is at least five times greater than the second volume. In some implementations, the first volume is between about 50 cubic inches and about 3,000 cubic inches. In some implementations, the first volume is between about 250 cubic inches and about 1,500 cubic inches. In some implementations, the first volume is between about 500 cubic inches and about 1,000 cubic inches. In some implementations, the second volume is between about 5 cubic inches and about 1,000 cubic inches. In some implementations, the second volume is between about 10 cubic inches and about 500 cubic inches. In some implementations, the second volume is between about 25 cubic inches and about 150 cubic inches.

To convert the bag 100 from the first configuration (FIG. 2A) into the second configuration (FIG. 2C), with the bag 100 generally being empty or with one or more items therein, the bi-folding base 150 is folded in the directions of arrows A (FIGS. 2B and 2C). As shown in FIG. 2B, the bi-folding base 150 is folded about the fold line 200 (which is perpendicular to the page) such that the first long edges 152*a*, 153*a* of the first and second rigid panels 152, 153, respectively, are moved downward relative to the fold line 200 and away from the main opening 102 (FIG. 1A)/top of the bag 100. In some implementations, during the conversion, the fold line 200 does not move relative to the main opening 102 (FIG. 1A)/top of the bag 100. Rather, it is the first long edges 152*a*, 153*a* that pivot about the fold line 200.

Because the first long edge 152*a* of the first rigid panel 152 is coupled to the first side 110 and because the first long edge 153*a* of the second rigid panel 153 is coupled to the second side 130, as the bi-folding base 150 is folded, the first and second sides 110, 130 are stretched and/or pulled taught generally in a downward direction (relative to the main opening 102). As such, the folding (e.g., conversion of the bag 100 from the first configuration into the second configuration) causes the height of the bag 100 to increase and the maximum depth of the bag 100 to decrease. Specifically, as illustrated by comparing FIGS. 2A and 2C, the height, $h_1$, of the bag 100 in the first configuration (FIG. 2A) is less than the height, $h_2$, of the bag 100 in the second configuration (FIG. 2C) and the maximum depth, $d_1$, of the bag 100 in the first configuration (FIG. 2A) is greater than the maximum depth, $d_2$, of the bag 100 in the second configuration (FIG. 2C). It is noted that the width, $W_b$, of the bag 100 remains unchanged due to the conversation of the bag 100 between the first and second configurations.

According to some implementations, a ratio of a height of the bag 100 in the second configuration to a width of the bag 100 is between about 5:1 and about 1.5:1. According to some implementations, a ratio of a height of the bag 100 in the second configuration to a width of the bag 100 is between about 3:1 and about 2:1. According to some implementations, a maximum depth of the bag 100 in the second configuration is at least about seventy-five percent less than a maximum depth of the bag 100 in the first configuration. According to some implementations, a maximum depth of the bag 100 in the second configuration is at least about fifty percent less than a maximum depth of the bag 100 in the first configuration.

When the bag 100 is completely converted into the second configuration (FIG. 2C), the fasteners 160 coupled to the first rigid panel 152 engage the fasteners 160 coupled to the second rigid panel 153 to aid in maintaining the bag 100 in the second configuration. The fasteners 160 work to hold the bag 100 in the second configuration even through the bi-folding base 150 is biased into the flat position (FIG. 2A). In some implementation, some of the fasteners 160 are magnets and some of the fasteners 160 are just metal feet and/or ferromagnetic material. In some other implementations, all of the fasteners are magnets and/or include magnets.

Figure 3A:
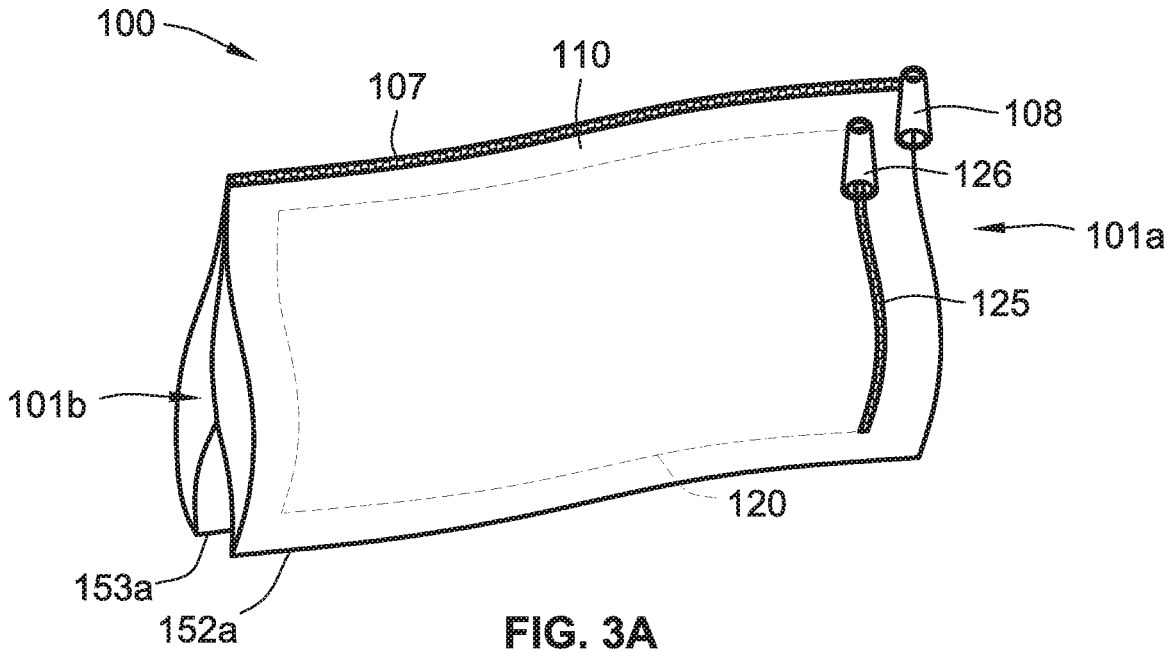
FIG. 3A is a first side perspective view of the convertible bag in the second configuration according to some implementations of the present disclosure.
Figure 3B:
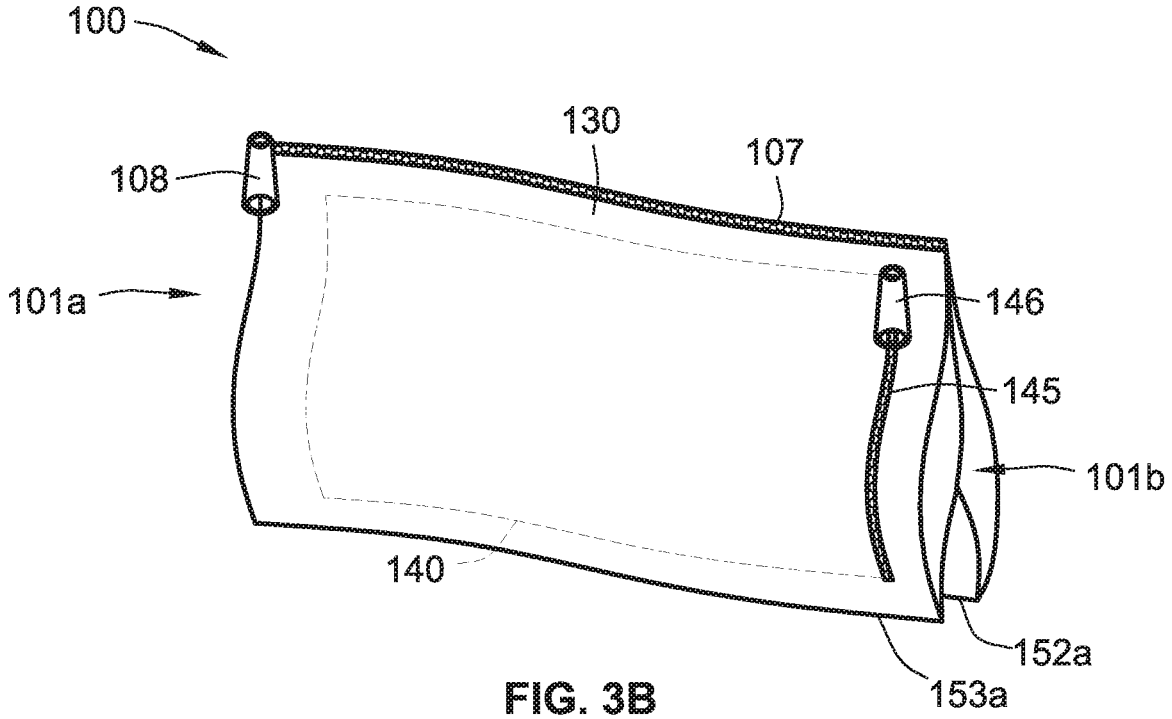
FIG. 3B is a second side perspective view of the convertible bag of FIG. 3A.
Figure 3C:
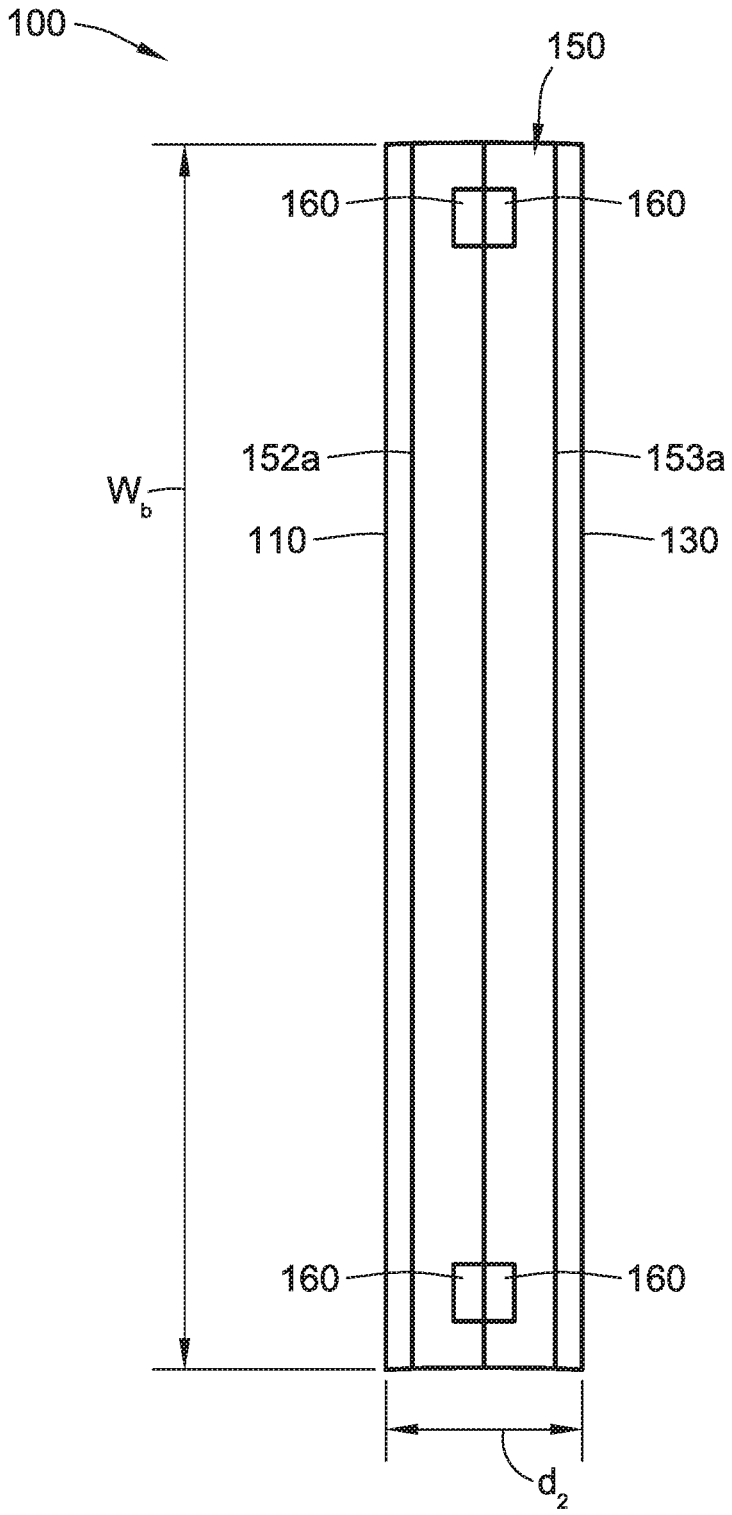
FIG. 3C is a bottom view of the convertible bag of FIG. 3A.

Referring generally to FIGS. 3A-3C, the bag 100 is shown in the second or folded configuration. Comparing FIGS. 1A-1C with FIGS. 3A-3C highlights the different shape of the bag 100 in the first configuration (FIGS. 1A-1C, 2A) without any items therein and the second configuration (FIGS. 3A-3C, 2C) without any items therein. In some implementations, as best shown in FIGS. 3A and 3B, when the bag 100 is in the second configuration, a bottom of the bag 100 is generally formed by the first long edge 152*a* of the first rigid panel 152 and the first long edge 153*a* of the second rigid panel 153.

Figure 4A:
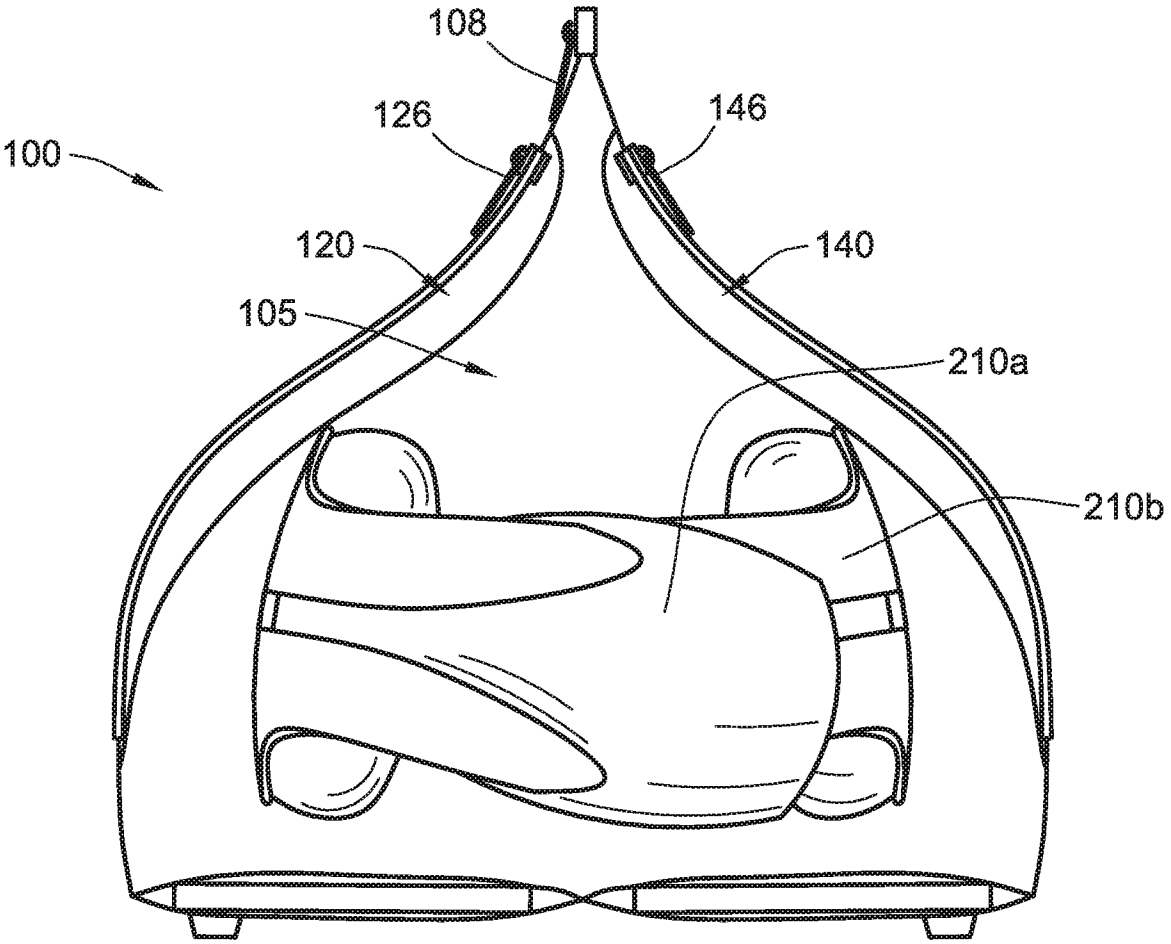
FIG. 4A is a cross-sectional end view of the convertible bag of FIG. 1A in the first configuration with a first pair of items stored therein according to some implementations of the present disclosure.
Figure 4B:
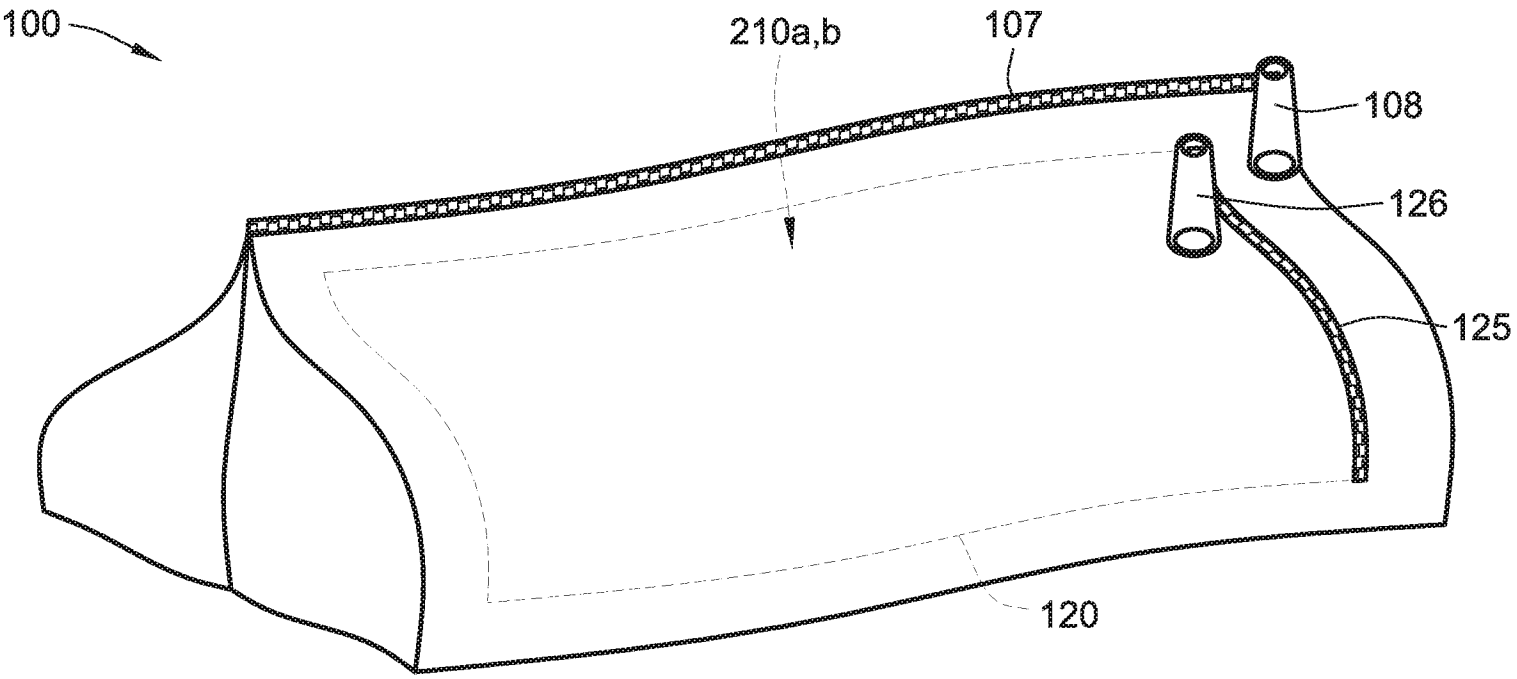
FIG. 4B is a perspective view of the convertible bag of FIG. 4A with the first pair of items stored therein.

Now referring to FIGS. 4A and 4B, the bag 100 is shown in the first configuration with items 210*a,b* therein. As shown, the items 210*a,b* cause the bag 100 to stretch to accommodate the items 210*a,b* as compared to the bag 100 in FIGS. 1A-1C. The items 210*a,b* shown are shoes or high heels, but any items can be positioned within the bag 100. Specifically, the items 210*a,b* are positioned within the interior cavity 105 of the bag 100. Thus, the items 210*a,b* were placed into the bag 100 via the main opening 102. Further, inclusion of the items 210*a,b* in the interior cavity 105 causes the first side pocket 120 and the second side pocket 140 to collapse and/or press against the first side 110 and the second side 130, respectively, which may limit use of the first side pocket 120 and/or the second side pocket 140.

Figure 5B:
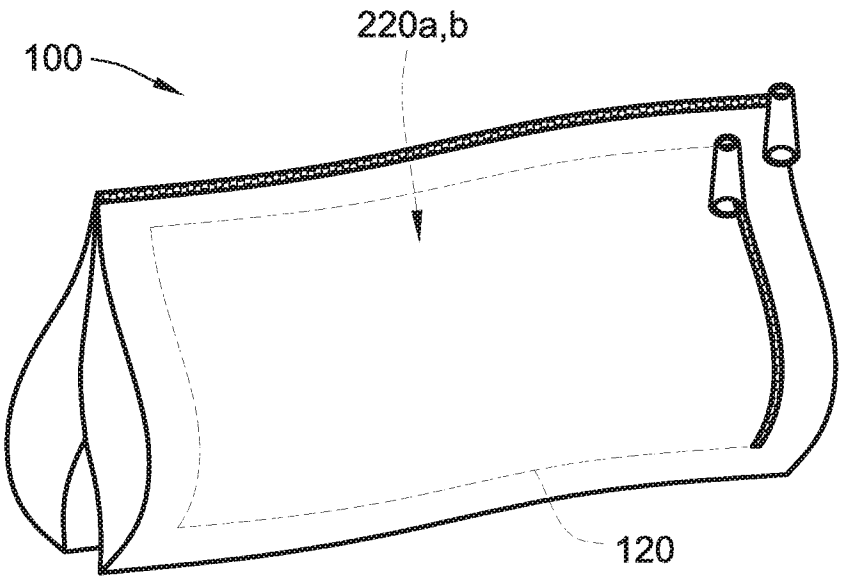
FIG. 5B is a perspective view of the convertible bag of FIG. 5A with the second pair of items stored therein.
Figure 5A:
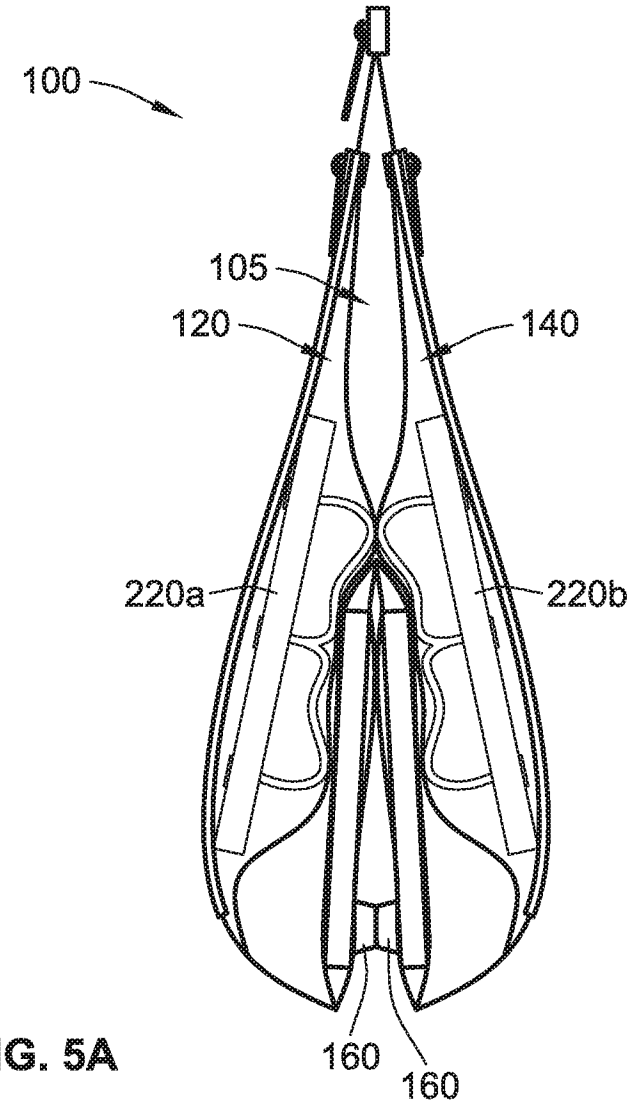
FIG. 5A is a cross-sectional end view of the convertible bag of FIG. 3A in the second configuration with a second pair of items stored therein according to some implementations of the present disclosure.

Now referring to FIGS. 5A and 5B, the bag 100 is shown in the second configuration with items 220*a,b* therein that cause the bag 100 to stretch to accommodate the items 220*a,b* as compared to the bag 100 in FIGS. 3A-3C. As shown, the items 220*a,b* are flip flops or sandals. Specifically, a first one of the items 220*a* is positioned within the first side pocket 120 of the bag 100 and a second one of the items 220*b* is positioned within the second side pocket 140 of the bag 100. Thus, the first item 220*a* was placed into the bag 100 via the first opening 115 and the second item 220*b* was placed into the bag 100 via the second opening 135. Further, inclusion of the items 220*a,b* in the first side pocket 120 and in the second side pocket 140 causes the first side pocket 120 and the second side pocket 140 to expand into the interior cavity 105 of the bag 100 (see FIG. 5A), which may limit use of the interior cavity 105.

In some implementations, one or more sleeves or folds of material (not shown) are coupled to the inside surface of the bi-folding base 150 to provide wallet-type credit card slots for holding credit cards or the like against the inside surface of the bi-folding base 150.

Generally referring to FIGS. 6A-10C, a bag 300 that is similar to the bag 100 is shown and described. As further described below, the bag 300 mainly differs from the bag 100, shown in FIGS. 1A-5B and described above, in that (1) the bag 300 includes a flap portion 331 (FIG. 6A) that aids in closing the bag 300 instead of the main zipper track 107, (2) the bag 300 includes fasteners 390 (FIGS. 6A and 6B) coupled to its endwalls 301*a,b* to aid in selectively biasing the endwalls 301*a,b* towards an interior cavity 305 (FIG. 8A) of the bag 300, (3) the bag 300 includes double stitches 370 (FIG. 7A) that aid in biasing the endwalls 301*a,b* towards the interior cavity 305 (FIG. 8A) of the bag 300, and (4) a foldable base 350 (FIGS. 8A-8C) of the bag 300 has a different configuration (described in detail below) than the bi-folding base 150 of the bag 100. Other differences exist as evident from the description herein and the figures. It is contemplated that any of the elements/features of the bag 300 can be incorporated into the bag 100 and similarly that any of the elements/features of the bag 100 can be incorporated into the bag 300.

Figure 6A:
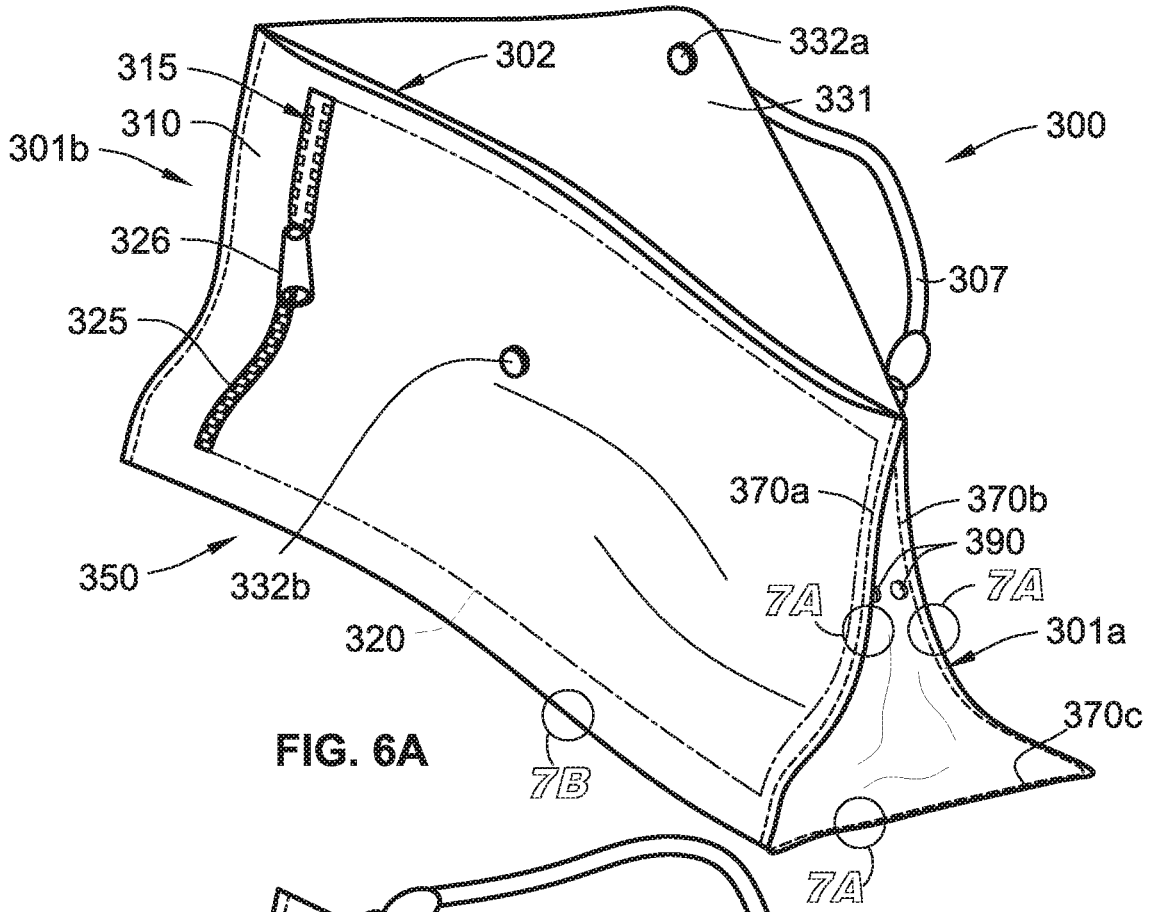
FIG. 6A is a first side perspective view of a bag in a first configuration according to some implementations of the present disclosure.
Figure 6B:
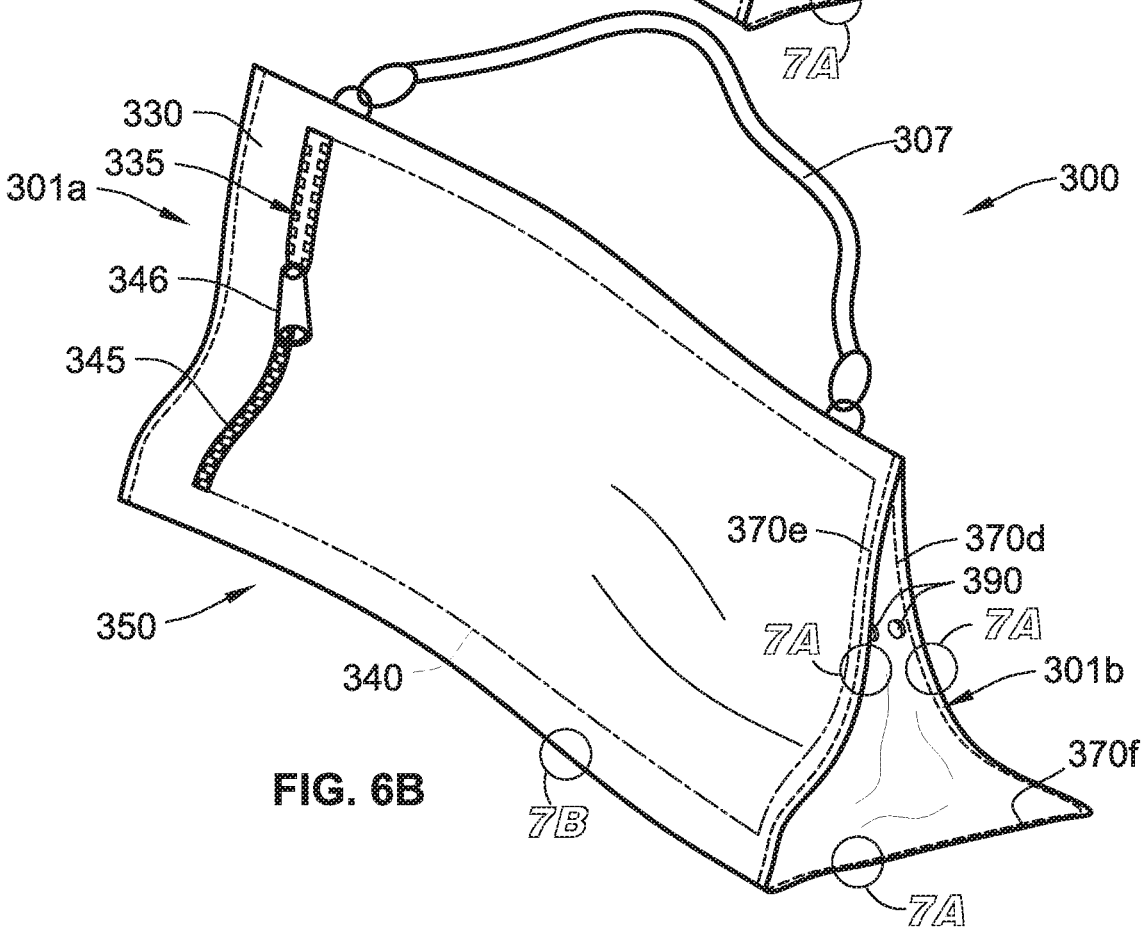
FIG. 6B is a second side perspective view of the bag of FIG. 6A.

Referring generally to FIGS. 6A and 6B, the bag 300 includes a first side 310, a second opposing side 330, a first endwall 301*a*, a second opposing endwall 301*b*, and a foldable base 350. The bag 300 can have any size, any shape, any color, and be made from any material or combination of materials. For example, the bag 300 can be made of leather, cardboard, plastic, fabric, nylon, metal, etc., or any combination thereof. Further, the bag 300 can be made of any number of parts or panels or sheets of material (e.g., one sheet of material, two sheets of material, five sheets of material, etc.) that are coupled together to form the bag 300.

As best shown in FIG. 6A, the first side 310 of the bag 300 has an absolute width and an absolute height, which are the same as, or similar to, the absolute width and the absolute height described above in connection with the of the first side 110 of the bag 100.

The first side 310 of the bag 300 has a first opening 315 therein (FIG. 6A), which is the same as, or similar to, the first opening 115 described above in connection with the bag 100. As best shown in FIG. 6A, the first opening 315 provides access from the outside of the bag 300 (as opposed to from the inside of the bag 300) into a first side pocket 320, which is the same as, or similar to, the first side pocket 120 described above in connection with the bag 100.

As shown in FIG. 6A, a first zipper track 325 is coupled to the first opening 315 such that the first opening 315 can be opened and closed via a first zipper pull 326. Alternatively, the first opening 315 can be opened and closed via any other method (e.g., one or more buttons, one or more snaps, one or more clasps, one or more buckles, one or more magnets, etc., or any combination thereof). Further, in some implementations, the first opening 315 can remain open without any type of mechanism to close it. In such alternative implementations, items (e.g., sandal(s), flip flop(s), etc.) can still remain within the first side pocket 320 due to the orientation (e.g., vertical relative to the natural carrying position of the bag 300) of the first opening 315, friction of the item when placed in the first pocket 320, the size of the item within the first pocket 320, gravity, etc. or any combination thereof such that a physical fastening mechanism (e.g., the first zipper track 325 and the first zipper pull 326) is not necessary in all implementations.

As best shown in FIG. 6B, the second side 330 of the bag 300 has an absolute width and an absolute height, which are the same as, or similar to, the absolute width and the absolute height described above in connection with the of the second side 130 of the bag 100.

The second side 330 of the bag 300 has a second opening 335 therein (FIG. 6B) that is the same as, or similar to, the first opening 315. As best shown in FIG. 6B, the second opening 335 provides access from the outside of the bag 300 (as opposed to from the inside of the bag 300) into a second side pocket 340, which is the same as, or similar to, the second side pocket 140 described above in connection with the bag 100.

As shown in FIG. 6B, a second zipper track 345 is coupled to the second opening 335 such that the second opening 335 can be opened and closed via a second zipper pull 346. Alternatively, the second opening 335 can be opened and closed via any other method (e.g., one or more buttons, one or more snaps, one or more clasps, one or more buckles, one or more magnets, etc., or any combination thereof). Further, in some implementations, the second opening 335 can remain open without any type of mechanism to close it in the same, or similar, manner as described above in connection with the first opening 315.

As shown in FIG. 6A, the first opening 315 is adjacent to (e.g., closer to) the first endwall 301*a* of the bag 300 and, as shown in FIG. 6B, the second opening 335 is adjacent to (e.g., closer to) the second opposing endwall 301*b* of the bag 300. As such, a user of the bag 300 can hold the bag 300 with one hand (e.g., left hand) and operate the first zipper pull 326 with the other hand (e.g., right hand) and then rotate the bag 180 degrees about a vertical axis through the center of the bag 300 and also hold the bag 300 with the same hand (e.g., left hand) and operate the second zipper pull 346 with the same hand (e.g., right hand). Alternatively, the first opening 315 and the second opening 335 can both be adjacent to the same end of the bag 300 (e.g., both adjacent to the first endwall 301*a* or both adjacent to the second opposing endwall 301*b*).

The first side 310 and the second side 330 of the bag 100 generally come together at the top or upper portion of the bag 300 to form a main opening 302 (FIG. 6A) of the bag 300. The main opening 302 provides access from the outside of the bag 300 into an interior cavity 305 (FIGS. 8A-8C) of the bag 300. The interior cavity 305 is separate and distinct from the first side pocket 320 and from the second side pocket 340, but the first side pocket 320 and the second side pocket 340 are generally positioned within the interior cavity 305 of the bag 300. The main opening 302 is the same as, or similar to, the main opening 102 described above in connection with bag 100; however, the bag 300 includes a flap portion 331 not included in the bag 100. The flap portion 331 is integral and/or monolithic with the second side 330 such that the flap portion 331 can fold over the main opening 302 to aid in closing the bag 300 and/or limit access into the bag 300 via the main opening 302.

Figure 8A:
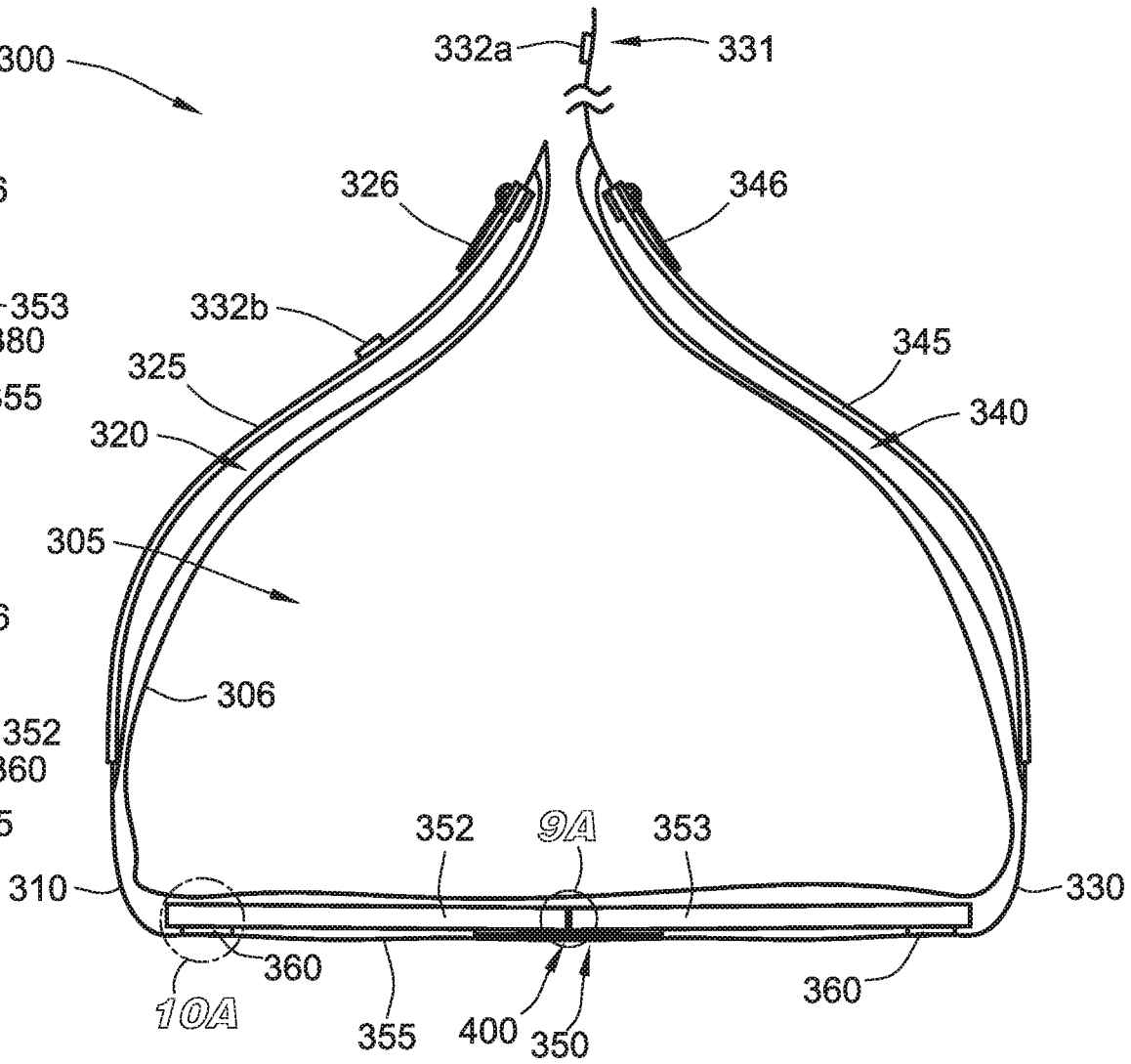
FIG. 8A is a cross-sectional end view of the bag of FIG. 6A in the first configuration.

In some implementations, the interior cavity 305 is lined with a liner 306. The liner 306 can be made from any material, such as, for example, fabric, nylon, leather, cardboard, plastic, metal, etc., or any combination thereof. As best shown in FIG. 8A, the liner 306 generally obscures the first and second rigid panels 352, 353 when viewing the interior cavity 305 through the main opening 302.

As shown in FIG. 6A, the flap portion 331 includes a fastener 332*a,b* that aids in maintaining the flap portion 331 in a closed or secured position (FIG. 6B). Specifically, the flap portion 331 includes a first half 332*a* the fastener 332*a,b* that mates with a corresponding second half 332*b* of the fastener 332*a,b*, where the second half 332*b* is coupled to the first side 310 of the bag 300. The fastener 332*a,b* can include any type of fastener (e.g., one or more buttons, one or more snaps, one or more clasps, one or more buckles, one or more magnets, etc., or any combination thereof).

In some implementations, the flap portion 331 is integral with the first side 310 of the bag 300. In other implementations, the bag 300 does not include a flap portion 331 such that the main opening 302 is the same as, or similar to, the main opening 102 of the bag 100.

As shown in FIGS. 6A and 6B, the bag 300 includes a strap 307. The strap can be made of any material, such as, for example, leather, fabric, plastic, nylon, metal, etc., or any combination thereof. As best shown in FIG. 6B, the strap 307 is coupled to second side 330 and/or the flap portion 331 via one or more loops/hooks. The strap 307 can be removed from the bag 300 such that the bag 300 can be used with or without the strap 307*b*.

The first side 310 and the second side 330 of the bag 300 are coupled together at their ends via the endwalls 301*a,b* of the bag 300. As shown, the first endwall 301*a* is a separate and distinct piece of material from the first side 310, the second side 330, and the foldable base 350 of the bag 300. Similarly, the second endwall 301*b* is a separate and distinct piece of material from the first side 310, the second side 330, and the foldable base 350 of the bag 300. As such, the first endwall 301*a* is coupled to the first side 310, the second side 330, and the foldable base 350 of the bag 300 and the second endwall 301*b* is coupled to the first side 310, the second side 330, and the foldable base 350 of the bag 300.

In some implementations, the coupling of the endwalls 301*a,b* to the first side 310, the second side 330, and the foldable base 350 of the bag 300 includes one or more double stitches 370. By double stitch it is meant that two different stitches are made at the joints between the pieces of material forming the sides, the endwalls, and the foldable base. Specifically, two stitches are made and/or included between the first endwall 301*a* and the first side 310, between the first endwall 301*a* and the second side 330, and between the first endwall 301*a* and the foldable base 350 of the bag 300. Similarly, two stitches are made and/or included between the second endwall 301*b* and the first side 310, between the second endwall 301*b* and the second side 330, and between the second endwall 301*b* and the foldable base 350 of the bag 300.

Figure 7A:
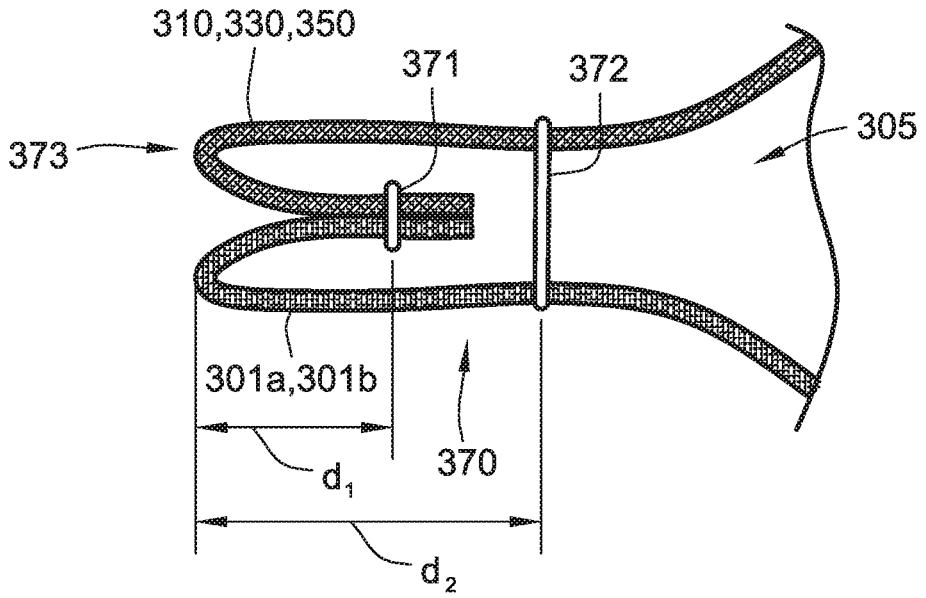
FIG. 7A is a cross-sectional partial view of a first stitch-type of the bag of FIG. 6A.

As shown in FIG. 7A, the double stitch 370 used to couple the endwalls 301*a,b* to the first side 310, the second side 330, and the foldable base 350 of the bag 300 includes a hidden interior stitch 371 and an exposed exterior top stitch 372. The hidden interior stitch 371 is a stitch used to couple pieces of material together that is hidden within the interior cavity 305 of the bag 300 due to the joined pieces being folded over such that the hidden interior stitch 371 is hidden from the outside of the bag 300. The exposed exterior top stitch 372 is a top stitch used to further couple pieces of material together that is exposed to the outside of the bag 300 due to the exposed exterior top stitch 372 being applied to the exterior of the bag 300 after the joined pieces are folded over such that the hidden interior stitch 371 is hidden from the outside of the bag 300.

The hidden interior stitch 371 is located a first distance $d_1$ from an outer edge 373 of the bag 300. The exposed exterior top stitch 372 is located a second distance $d_2$ from the outer edge 373 of the bag 300. As shown, the second distance $d_2$ is greater than the first distance $d_1$. In some implementations, the second distance $d_2$ is between about 0.125 inches and about 0.5 inches. In some implementations, the second distance $d_2$ is about 0.25 inches. In some implementations, the first distance $d_1$ is between about 0.03125 inches and about 0.125 inches. In some implementations, the first distance $d_1$ is about 0.0625 inches.

Figure 8B:
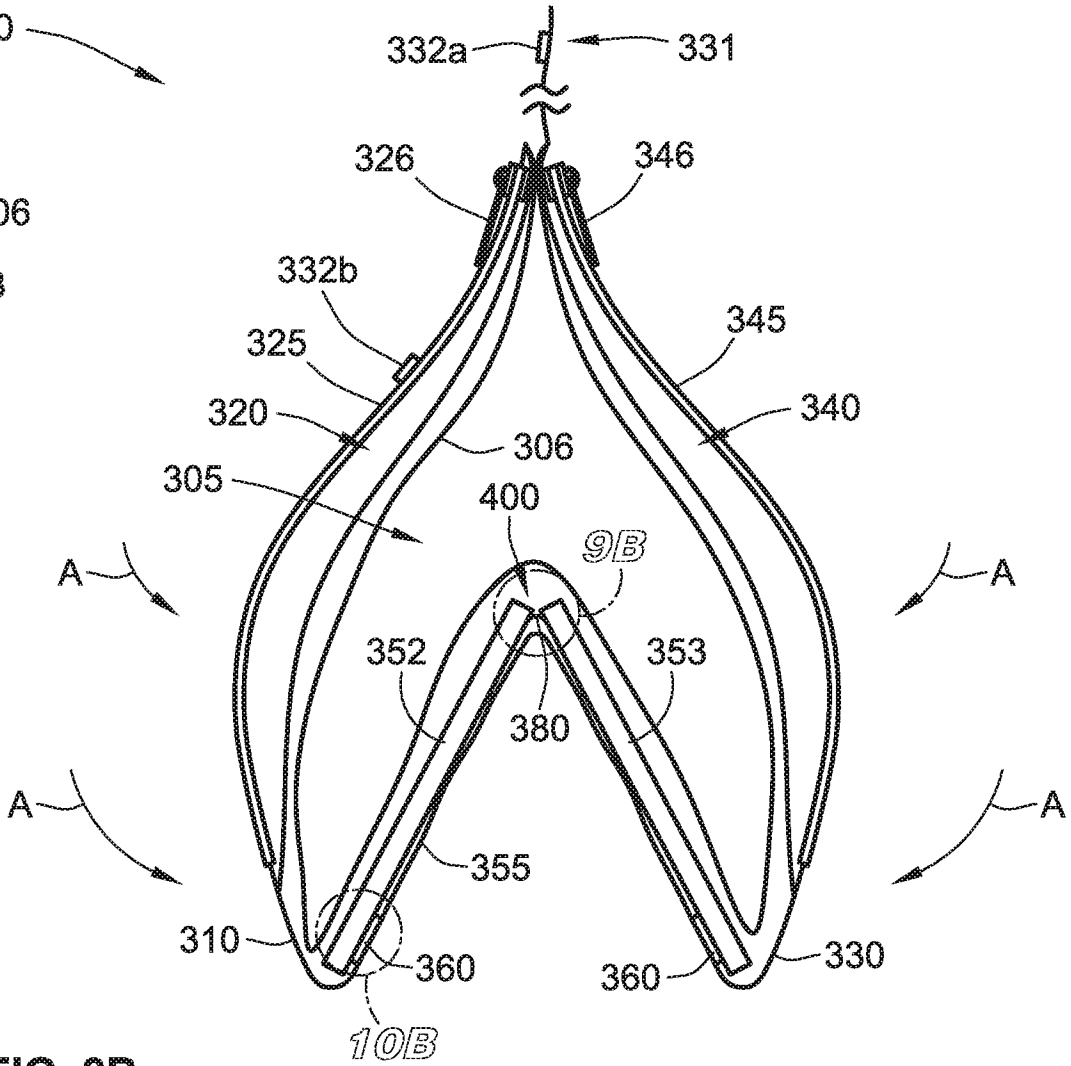
FIG. 8B is a cross-sectional end view of the bag of FIG. 6A partially converted from the first configuration of FIG. 6A into a second configuration according to some implementations of the present disclosure.
Figure 8C:
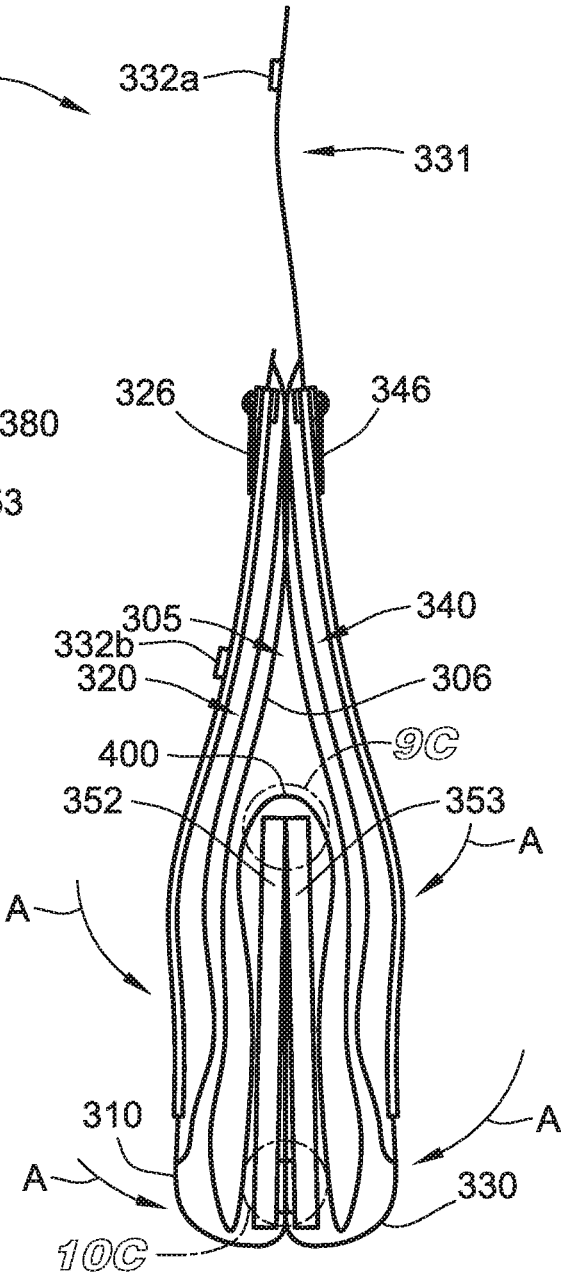
FIG. 8C is a cross-sectional end view of the bag of FIG. 6A converted from the first configuration of FIG. 6A into the second configuration according to some implementations of the present disclosure.

While both of the hidden interior stitch 371 and the exposed exterior top stitch 372 aid in coupling the endwalls 301*a,b* with the first side 310, the second side 330, and the foldable base 350, the exposed exterior top stitch 372 further aids in biasing the first endwall 301*b* and second the endwall 301*b* into the interior cavity 305 when the bag 300 is in the first confirmation (FIG. 8A) and/or in the second configuration (FIG. 8C).

Referring back to FIG. 6A, the first endwall 301*a* is coupled to the first side 310 via a first double stitch 370*a*; the first endwall 301*a* is coupled to the second side 310 via a second double stitch 370*b*; and the first endwall 301*a* is coupled to the foldable base 350 via a third double stitch 370*c*. Referring to FIG. 6B, the second endwall 301*b* is coupled to the first side 310 via a fourth double stitch 370*d*; the second endwall 301*b* is coupled to the second side 310 via a fifth double stitch 370*e*; and the second endwall 301*b* is coupled to the foldable base 350 via a sixth double stitch 370*f*. While six different double stitches 370*a-f* are shown and described, it is contemplated that any number of separate and distinct and/or contiguous double stitches can be included in the bag 300. For example, in some implementations, the first, second, and third double stitches 370*a,b,c* form one contiguous double stitch and the fourth, fifth, and sixth double stitches 370*a,b,c* form one contiguous double stitch.

While the first and second endwalls 301*a,b* are shown and described as being separate and distinct pieces of material from the first side 310, the second side 330, and the foldable base 350, it is contemplated that in some alternative implementations, the first and/or second endwalls 301*a,b* can be integral or monolithic with one or more of the first side 310, the second side 330, and the foldable base 350. For example, in some implementations, the first endwall 301*a* is monolithic with the first side 310 and the second endwall 301*b* is monolithic with the second side 330. For another example, in some implementations, the first side 310, the base sheet 355 (FIG. 8A) of the foldable base 350, and the second side 330 are monolithic. In such implementations where the endwalls 301*a,b* are monolithic with the first side 310, the second side 330, the foldable base 350, or any combination thereof, the hidden interior standard stitch 371 is not needed; however, the exposed exterior top stitch 372 can still be included to aid in biasing the endwalls 301*a,b* inwards toward the interior cavity 305 of the bag 305.

In addition to, or in lieu of, the double stitches 370*a-f*, a fastener 390 (FIGS. 6A and 6B) can be included on the first and/or second endwalls 301*a,b* to selectively aid in biasing the endwalls 301*a,b* inwards toward the interior cavity 305 of the bag 305. As shown, the fastener 390 is a snap having two halves (e.g., a male half and a corresponding female half) attached to the endwalls 301*a,b* in a spaced apart fashion such that coupling of the snaps together causes a portion of the material of the endwalls 301*a,b* to be bunched and forced inward towards the interior cavity 305 of the bag 300. As such, the fasteners 390 can be used to selectively aid in biasing the endwalls 301*a,b* inward as opposed to protruding outward and away from the interior cavity 305, which may be less aesthetically pleasing when the bag 300 is in the first and/or second configuration.

Figure 7B:
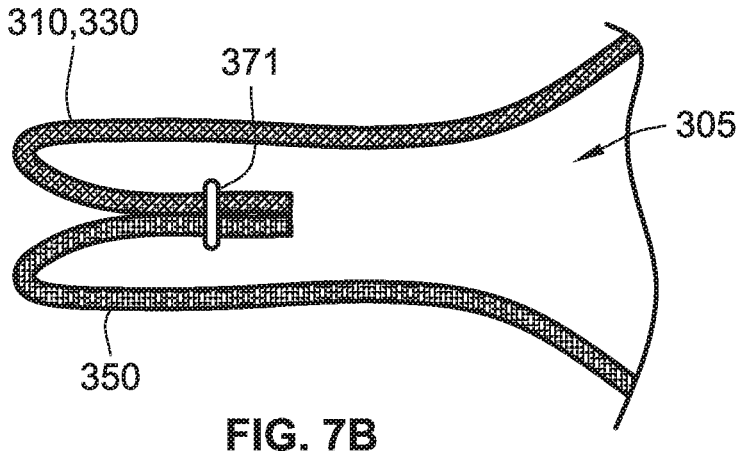
FIG. 7B is a cross-sectional partial view of a second stitch-type of the bag of FIG. 6A.

Referring to FIG. 7B, unlike the endwalls 301*a,b*, the first side 310 and the second side 330 are coupled to the foldable base 350 via the hidden interior standard stitch 371 and not with an exposed exterior top stitch 372. Although in some implementations, a double stitch can also be included to couple the first side 310 and the second side 330 to the foldable base 350, such as, for example, for aesthetic and/or functional purposes.

Referring to FIG. 8A, the foldable base 350 of the bag 300 is shown in a generally flat or planar position or configuration. The foldable base 350 is similar to the bi-folding base 150 of the bag 100. The foldable base 350 includes a first rigid panel 352, a second rigid panel 353, a flexible fastener 380, one or more fasteners 360, and a base sheet 355.

The foldable base 350 is generally formed into two equal halves that are coupled together and foldable about a fold line or a center line 400 of the bag 300. The foldable base 350 can be made of leather, cardboard, plastic, fabric, nylon, metal, etc., or any combination thereof.

Figure 9A:
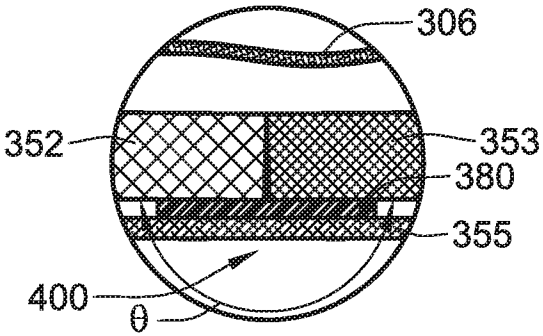
FIG. 9A is a cross-sectional partial view of a central portion of a foldable base of the bag of FIG. 6A when the bag is in the first configuration (FIG. 8A) according to some implementations of the present disclosure.
Figure 10A:
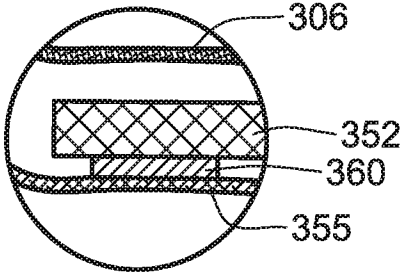
FIG. 10A is a cross-sectional partial view of an end portion of the foldable base of the bag of FIG. 6A when the bag is in the first configuration (FIG. 8A) according to some implementations of the present disclosure.

Each of the rigid panels 352, 353 includes a rigid sheet of material, such as, for example, a metal sheet, a plastic sheet, a sheet of cardboard, etc., or a combination thereof. In some implementations, a thickness of the first and second rigid panels 352, 353 is between about 0.1 inches and about 0.4 inches. In some implementations, the thickness of the first and second rigid panels 352, 353 is about 0.25 inches. As best shown in FIG. 9A, the first rigid panel 352 is coupled to the second rigid panel 353 at the fold line 400 via the flexible fastener 380 coupled to a lower surface of the first and second rigid panels 352, 353 that is opposite the upper surface of the first and second rigid panels 352, 353. As shown, the upper surface of the first and second rigid panels 352, 353 is directly adjacent to the interior cavity 305 of the bag 300.

The flexible fastener 380 can be, for example, a strip, a flexible strip, a bendable strip, an adhesive strip, tape, a strip of fabric glued and/or stitched to the first and second rigid panels 352, 353, etc. or any combination thereof. As shown by comparing FIGS. 9A-9C, as the bag 300 converts from the first configuration (FIG. 8A) to the second configuration (FIG. 8C), the flexible fastener 380 permits the first rigid panel 352 and the second rigid panel 353 to fold and/or rotate/pivot relative to the center line 400.

Figure 9B:
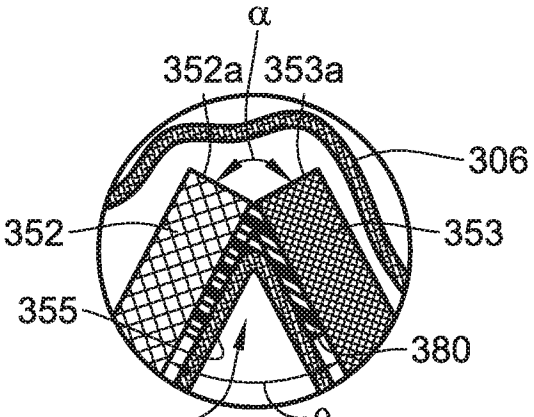
FIG. 9B is a cross-sectional partial view of the central portion of the foldable base of the bag of FIG. 6A when the bag is in the partially converted configuration (FIG. 8B) according to some implementations of the present disclosure.
Figure 10B:
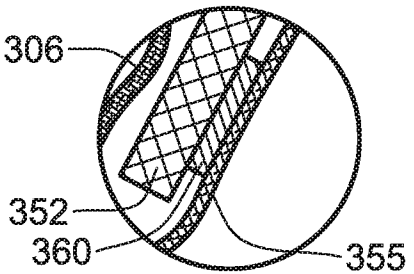
FIG. 10B is a cross-sectional partial view of the end portion of the foldable base of the bag of FIG. 6A when the bag is in the partially converted configuration (FIG. 8B) according to some implementations of the present disclosure.
Figure 9C:
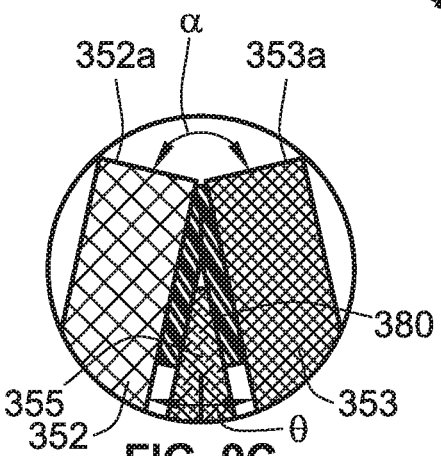
FIG. 9C is a cross-sectional partial view of the central portion of the foldable base of the bag of FIG. 6A when the bag is in the second configuration (FIG. 8C) according to some implementations of the present disclosure.

Additionally, as shown by comparing FIGS. 9A-9C, as the bag 300 converts from the first configuration (FIG. 8A) to the second configuration (FIG. 8C), the first rigid panel 352 and the second rigid panel 353 define an angle, θ, that changes responsive to the foldable base 350 moving between the unfolded or straight position (FIGS. 8A and 9A) and the folded or bent position (FIGS. 8C and 9C). As shown in FIGS. 8A and 9A, the angle, θ, when the bag 300 is in the first configuration is about 180 degrees and as shown in FIGS. 8C and 9C, the angle, θ, when the bag 300 is in the second configuration is between about 10 degrees and about 40 degrees.

Similarly, an inner edge 352*a* (FIGS. 9B and 9C) of the first rigid panel 352 and an inner edge 353*a* (FIGS. 9C and 9C) the second rigid panel 353 define an angle, α, that changes responsive to the foldable base 350 moving between the unfolded or straight position (FIGS. 8A and 9A) and the folded or bent position (FIGS. 8C and 9C). As shown in FIGS. 8A and 9A, the angle, α, when the bag 300 is in the first configuration is about 0 degrees and as shown in FIGS. 8C and 9C, the angle, α, when the bag 300 is in the second configuration is about 170 degrees. It is contemplated that the angle, α, can be between about 90 degrees and about 180 degrees, between about 145 degrees and about 180 degrees, and/or about 170 degrees.

The connection or joint between the first and second rigid panels 352, 353 aids in preventing movement of the foldable base 350 in a first direction, but not in a second direction. As best shown in FIG. 9A, the thicknesses of the first and second rigid panels 352, 353 in conjunction with the flexible fastener 380 permit the foldable base 350 to fold in the direction of arrows A (FIGS. 8B and 8C) but not in an opposite direction.

The fasteners 360 (best shown in FIGS. 10A-10C) may also function as feet for the bag 300 in the same, or similar, manner as the fasteners 160 of the bag 100 described herein. The foldable base 350 includes four fasteners 360, where two of the fasteners 360 are coupled to the first rigid panel 352 and two of the fasteners 360 are coupled to the second rigid panel 353. Alternatively, any number of fasteners can be included on the foldable base 350 (e.g., one, two, three, four, eight, ten, twenty, etc.). As is explained in further detail below, the fasteners 360 aid in maintaining the bag 300 in a folded position or configuration (the second configuration shown in FIG. 8C). As shown, each of the fasteners 360 is a magnet, although one or more of the fasteners can include a ferromagnetic element, a clasp, a buckle, a button, a snap, a strap, hook and loop pads, a zipper track and zipper pull, or any combination thereof.

The base sheet 355 is coupled to the first and second rigid panels 352, 353 in any appropriate manner (e.g., glue, hot glue, tape, stitching, etc., or any combination thereof) such that the fasteners 360 and the flexible fastener 380 are sandwiched between the base sheet 355 and the first and second rigid panels 352, 353. The base sheet 355 can be made of leather, cardboard, plastic, fabric, nylon, metal, etc., or any combination thereof. The base sheet 355 is a separate and distinct piece of material from the first and second sides 310, 330 and the first and second endwalls 301*a,b*. Alternatively, the base sheet 355 can be integral or monolithic with one or more of the first and second sides 310, 330 and/or the first and second endwalls 301*a,b*.

Now referring to FIGS. 8A-8C, a method of converting the bag 300 from the first configuration (FIG. 8A) to the second configuration (FIG. 8C) is illustrated. As shown in FIG. 8A, the bag 300 is in the first configuration or an expanded, relatively larger configuration. As shown in FIG. 8C, the bag 300 is in the second configuration or a folded, relatively smaller configuration.

In the first configuration (FIG. 8A), the foldable base 350 is in its generally flat or planar position. In the second configuration (FIG. 8C), the foldable base 350 is in its generally folded or bent position such that the first rigid panel 352 abuts and/or is directly adjacent to the second rigid panel 353 (with the base sheet 355, the fasteners 360, and the flexible fastener 380 therebetween and preventing the first and second rigid panels 352, 353 from directly touching). Further, in the first configuration (FIG. 8A), the interior cavity 305 of the bag 300 is relatively large and ready to receive one or more relatively larger items therein (e.g., a pair of shoes or high heels, etc.). Whereas in the second configuration (FIG. 8C), the interior cavity 305 of the bag 300 is relatively small and only able to receive relatively smaller items therein (e.g., credit cards, lipstick, mints, etc., or any combination thereof). Put another way, in some implementations, when the bag 300 is in the first configuration, the interior cavity 305 of the bag 300 has a first volume and when the bag 300 is in the second configuration, the interior cavity 305 of the bag 300 has a second volume that is less than the first volume. Of course, the volume of the interior cavity 305 can be impacted (e.g., made smaller) by including one or more items within the first side pocket 320 and/or within the second side pocket 340, which would encroach into the interior cavity 305 resulting in a relatively smaller interior cavity 305. The volume of the interior cavity 305 in the first and second configurations is the same as, or similar to, the volume of the interior cavity 105 of the bag 100 described herein.

To convert the bag 300 from the first configuration (FIG. 8A) into the second configuration (FIG. 8C), with the bag 300 generally being empty or with one or more items therein, the foldable base 350 is folded in the directions of arrows A (FIGS. 8B and 8C). As shown in FIG. 8B, the foldable base 350 is folded about the fold line 400 (which is perpendicular to the page) such that the outside edges of the first and second rigid panels 352, 353, respectively, are moved downward relative to the fold line 400 and away from the main opening 302 (FIG. 6A)/top of the bag 300. In some implementations, during the conversion, the fold line 400 does not move relative to the main opening 302 (FIG. 6A)/top of the bag 300. Rather, it is the outside edges of the first and second rigid panels 352, 353 that pivot about the fold line 400 in the direction of arrows A.

As the first and second rigid panels 352, 353 pivot in the direction of arrows A, the first and second sides 310, 330 are stretched and/or pulled taught generally in a downward direction (relative to the main opening 302). As such, the folding (e.g., conversion of the bag 300 from the first configuration into the second configuration) causes the height of the bag 300 to increase and the maximum depth of the bag 300 to decrease in the same, or similar, fashion as described herein connection with the bag 100.

Figure 10C:
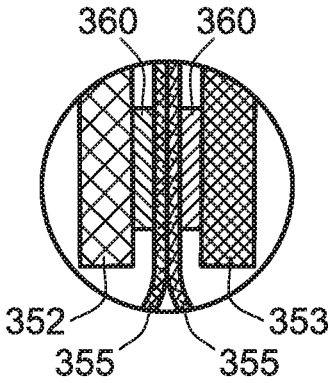
FIG. 10C is a cross-sectional partial view of the end portion of the foldable base of the bag of FIG. 6A when the bag is in the second configuration (FIG. 8C) according to some implementations of the present disclosure.

When the bag 300 is completely converted into the second configuration (FIG. 8C), the fasteners 360 coupled to the first rigid panel 352 engage (e.g., magnetically) the fasteners 360 coupled to the second rigid panel 353 to aid in maintaining the bag 300 in the second configuration (FIG. 8C). As best shown in FIG. 10C, the fasteners 360 work to hold the foldable base 350 in the folded position and the bag 300 in the second configuration (FIG. 8A).

As shown in the figures and described herein, the bag 100 includes two side pockets 120, 140 and the bag 300 similarly includes two side pockets 320, 340. In some alternative implementations, the bag 100 and/or the bag 300 only includes one of the two side pockets (e.g., the bag 100 only includes the first side pocket 120 and not the second side pocket 140, the bag 300 only includes the second side pocket 340 and not the first side pocket 320, etc.). In such alternative implementations, the one side pocket is large enough to fit, for example, both of a pair of flip flops therein through the associate one opening.

Figure 11A:
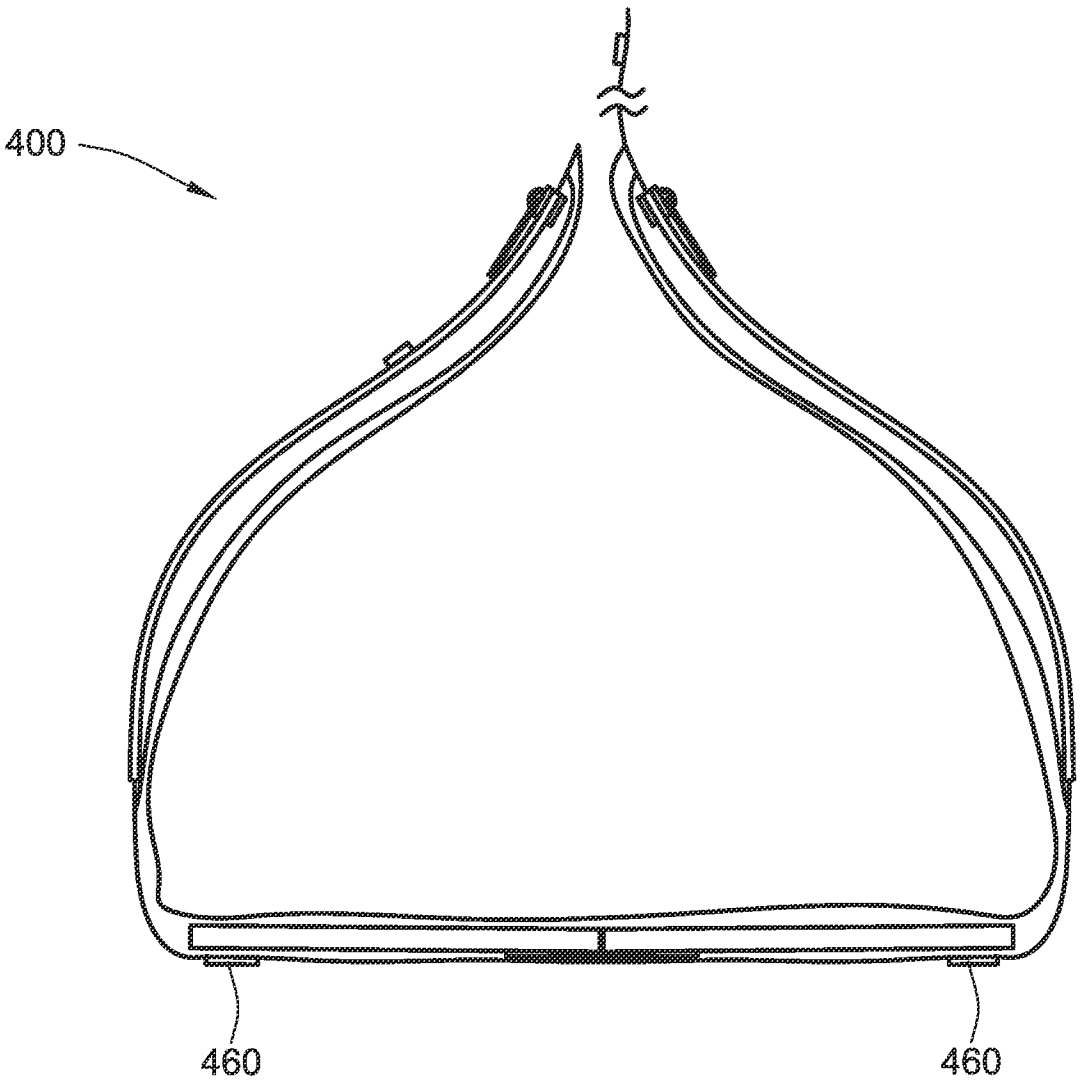
FIG. 11A is cross-sectional end view of a bag with one or more fasteners.
Figure 11B:
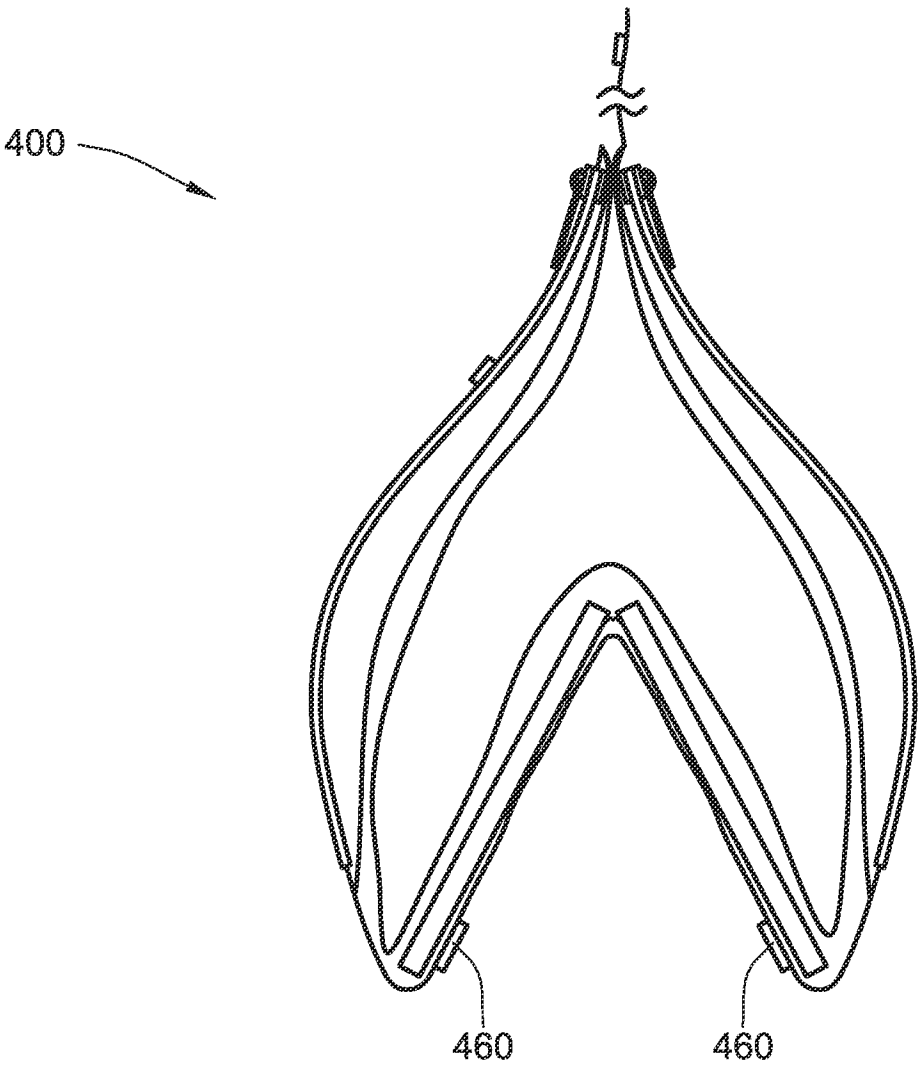
FIG. 11B is cross-sectional end view of the bag of FIG. 11A partially converted from a first configuration of FIG. 11A into a second configuration according to some implementations of the present disclosure.
Figure 11C:
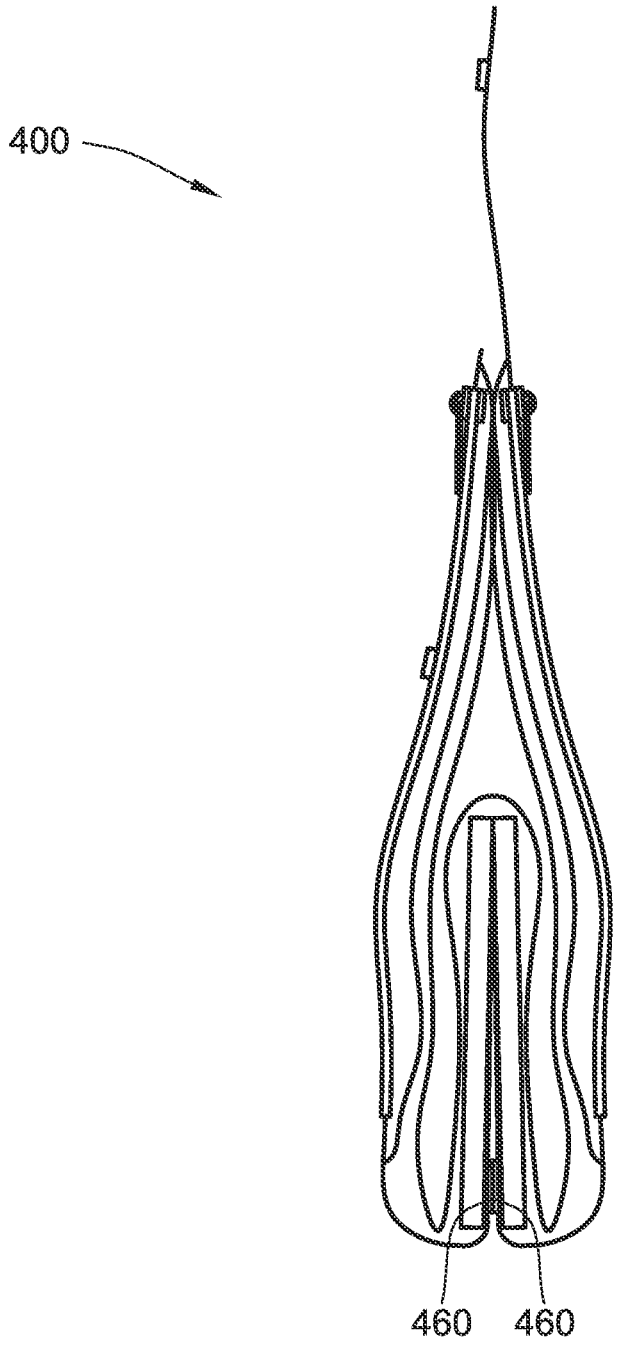
FIG. 11C is cross-sectional end view of the bag of FIG. 11A converted from the first configuration of FIG. 11A into the second configuration according to some implementations of the present disclosure.

Referring to FIGS. 11A-11C, a bag 400 that is the same as, or similar to, the bag 300 is shown and described. The bag 400 differs from the bag 300 in that the bag 400 includes one or more fasteners 460 as shown in FIGS. 11A-11C as compared with the one or more fasteners 360 as shown in FIGS. 6A-10C and described herein.

Alternative Implementations

Alternative Implementation 1. A bag convertible between a first configuration and a second configuration, the bag comprising: a first sidewall having a first opening therein providing access to a first side pocket; a second opposing sidewall having a second opening therein providing access to a second side pocket; a foldable base coupled to the first sidewall and the second side wall, the foldable base including a first rigid panel coupled to a second rigid panel such that the foldable base is configured to fold from a generally flat configuration to a folded configuration, thereby converting the bag from the first configuration to the second configuration; a first endwall coupled to (i) the foldable base via a first double stitch, (ii) the first side wall via a second double stitch, and (iii) the second sidewall via a third double stitch; and a second endwall coupled to (i) the foldable base via a fourth double stitch, (ii) the first side wall via a fifth double stitch, and (iii) the second sidewall via a sixth double stitch.

Alternative Implementation 2. The bag of Alternative Implementation 1, wherein the first, second, third, fourth, fifth, and sixth double stitches each includes a hidden interior stitch and an exposed exterior stitch.

Alternative Implementation 3. The bag of Alternative Implementation 2, wherein the hidden interior stitch is a standard stitch and the exposed exterior stitch is a top stitch.

Alternative Implementation 4. The bag of Alternative Implementation 2, wherein each of hidden interior stitches is located a first distance from a corresponding outer edge of the bag and each of exposed exterior stitches is located a second distance from a corresponding outer edge of the bag.

Alternative Implementation 5. The bag of Alternative Implementation 4, wherein the second distance is greater than the first distance.

Alternative Implementation 6. The bag of Alternative Implementation 4, wherein the second distance is between about 0.125 inches and about 0.5 inches.

Alternative Implementation 7. The bag of Alternative Implementation 4, wherein the second distance is about 0.25 inches.

Alternative Implementation 8. The bag of Alternative Implementation 4, wherein the first distance is between about 0.03125 inches and about 0.125 inches.

Alternative Implementation 9. The bag of Alternative Implementation 4, wherein the first distance is about 0.0625 inches.

Alternative Implementation 10. The bag of Alternative Implementation 1, wherein the first, second, and third double stitches aid in biasing the first endwall into an interior cavity of the bag in response to the bag being in the second configuration and wherein the fourth, fifth, and sixth double stitches aid in biasing the second endwall into the interior cavity of the bag in response to the bag being in the second configuration.

Alternative Implementation 11. The bag of Alternative Implementation 1, wherein the first, second, and third double stitches are one contiguous stitch.

Alternative Implementation 12. The bag of Alternative Implementation 1, wherein the first, second, and third double stitches are separate and distinct stitches.

Alternative Implementation 13. The bag of Alternative Implementation 1, further comprising a first fastener coupled to the first endwall and a second fastener coupled to the second endwall.

Alternative Implementation 14. The bag of Alternative Implementation 13, wherein the first fastener is a first snap including a male half and a female half and the second fastener is a second snap including a male half and a female half.

Alternative Implementation 15. The bag of Alternative Implementation 14, in response to the male half of the first snap being coupled to the female half of the first snap, the first snap aids in biasing the first endwall into an interior cavity of the bag and in response to the male half of the second snap being coupled to the female half of the second snap, the second snap aids in biasing the second endwall into the interior cavity of the bag.

Alternative Implementation 16. The bag of Alternative Implementation 1, wherein the foldable base further includes a strip coupling the first rigid panel to the second rigid panel.

Alternative Implementation 17. The bag of Alternative Implementation 16, wherein the strip is flexible and bendable.

Alternative Implementation 18. The bag of Alternative Implementation 17, wherein the strip is an adhesive strip.

Alternative Implementation 19. The bag of Alternative Implementation 16, responsive to the foldable base being in the generally flat configuration, the first and second rigid panels define an upper surface adjacent to an interior cavity of the bag and an opposing lower surface, the strip being coupled to the opposing lower surface of the first and second rigid panels and not to the upper surface of the first and second rigid panels.

Alternative Implementation 20. The bag of Alternative Implementation 16, wherein the strip permits the foldable base to fold in a first direction and aids in preventing the foldable base from folding in a second opposing first direction.

Alternative Implementation 21. The bag of Alternative Implementation 1, wherein the first configuration is an expanded configuration and the second configuration is a collapsed configuration.

Alternative Implementation 22. The bag of Alternative Implementation 1, responsive to the bag being in the first configuration, an interior of the bag has a first volume and responsive to the bag being in the second configuration, the interior of the bag has a second volume that is less than the first volume.

Alternative Implementation 23. The bag of Alternative Implementation 22, wherein the first volume is at least two times greater than the second volume.

Alternative Implementation 24. The bag of Alternative Implementation 1, wherein the first side pocket protrudes into an interior of the bag and wherein the second side pocket protrudes into the interior of the bag.

Alternative Implementation 25. The bag of Alternative Implementation 1, wherein the first opening is adjacent to a first end of the bag and the second opening is adjacent to a second opposing end of the bag.

Alternative Implementation 26. The bag of Alternative Implementation 1, wherein the first and second side pockets are only accessible from an exterior of the bag.

Alternative Implementation 27. The bag of Alternative Implementation 1, wherein the first rigid panel has a thickness, a pair of opposing long edges, and a pair of opposing short edges and the second rigid panel has a thickness, a pair of opposing long edges, and a pair of opposing short edges.

Alternative Implementation 28. The bag of Alternative Implementation 27, wherein the thickness of the first and second rigid panels is between about 0.1 inches and about 0.4 inches.

Alternative Implementation 29. The bag of Alternative Implementation 27, wherein the thickness of the first and second rigid panels is about 0.25 inches.

Alternative Implementation 30. The bag of Alternative Implementation 27, wherein a first of the opposing long edges of the first rigid panel is configured to abut a second of the opposing long edges of the second rigid panel responsive to the foldable base being in the generally flat configuration.

Alternative Implementation 31. The bag of Alternative Implementation 30, wherein the first of the opposing long edges of the first rigid panel is configured to be angled relative to the second of the opposing long edges of the second rigid panel responsive to the foldable base being in the folded configuration.

Alternative Implementation 32. The bag of Alternative Implementation 30, wherein the first of the opposing long edges of the first rigid panel and the second of the opposing long edges of the second rigid panel define an angle responsive to the foldable base being in the folded configuration.

Alternative Implementation 33. The bag of Alternative Implementation 32, wherein the angle is between about 90 degrees and about 180 degrees.

Alternative Implementation 34. The bag of Alternative Implementation 32, wherein the angle is between about 145 degrees and about 180 degrees.

Alternative Implementation 35. The bag of Alternative Implementation 32, wherein the angle is about 170 degrees.

Alternative Implementation 36. The bag of Alternative Implementation 1, wherein the foldable base further includes a first sheet of material coupled to the first rigid panel and the second rigid panel.

Alternative Implementation 37. The bag of Alternative Implementation 36, wherein the first sidewall includes a second sheet of material.

Alternative Implementation 38. The bag of Alternative Implementation 37, wherein the second sidewall includes a third sheet of material.

Alternative Implementation 39. The bag of Alternative Implementation 38, wherein the first sheet of material, the second sheet of material, and the third sheet of material are separate and distinct sheets of material.

Alternative Implementation 40. The bag of Alternative Implementation 38, wherein the first sheet of material, the second sheet of material, and the third sheet of material are a single monolithic sheet of material.

Alternative Implementation 41. The bag of Alternative Implementation 1, further comprising a fastener configured to aid in maintaining the foldable base in the folded configuration and the bag in the second configuration.

Alternative Implementation 42. The bag of Alternative Implementation 41, wherein the fastener includes one or more magnets, one or more ferromagnetic elements, one or more clasps, one or more buckles, one or more buttons, one or more snaps, one or more straps, one or more hook and loop pads, one or more zippers, or any combination thereof.

Alternative Implementation 43. The bag of Alternative Implementation 41, wherein the fastener includes one or more first magnets coupled to the first rigid panel and one or more second magnets coupled to the second rigid panel.

Alternative Implementation 44. The bag of Alternative Implementation 43, wherein the one or more first magnets are coupled to the first rigid panel via one or more corresponding bores such that the one or more first magnets are flush with the first rigid panel and the one or more second magnets are coupled to the second rigid panel via one or more corresponding bores such that the one or more second magnets are flush with the second rigid panel.

Alternative Implementation 45. The bag of Alternative Implementation 43, wherein the one or more first magnets are positioned between the first rigid panel and a sheet of material and the one or more second magnets are positioned between the second rigid panel and the sheet of material such that the one or more first magnet and the one or more second magnets are concealed by the sheet of material.

Alternative Implementation 46. The bag of Alternative Implementation 45, wherein the sheet of material is coupled to the first and second rigid panels and the one or more first magnets and the one or more second magnets such that each of the one or more first magnet and each of the one or more second magnets causes the sheet of material to protrude.

Alternative Implementation 47. The bag of Alternative Implementation 43, responsive to the bag being in the second configuration, the one or more first magnets are configured to magnetically couple with corresponding ones of the one or more second magnets to aid in maintaining the foldable base in the folded configuration and the bag in the second configuration.

Alternative Implementation 48. The bag of Alternative Implementation 1, responsive to the foldable base folding from the generally flat configuration to the folded configuration, a height of the bag is increased, a depth of the bag is decreased, and a width of the bag is maintained.

Alternative Implementation 49. The bag of Alternative Implementation 1, wherein a ratio of a height of the bag in the second configuration to a width of the bag is between about 5:1 and about 1.5:1.

Alternative Implementation 50. The bag of Alternative Implementation 1, wherein a ratio of a height of the bag in the second configuration to a width of the bag is between about 3:1 and about 2:1.

Alternative Implementation 51. The bag of Alternative Implementation 1, wherein a height of the bag in the first configuration is less than a height of the bag in the second configuration.

Alternative Implementation 52. The bag of Alternative Implementation 1, wherein a maximum depth of the bag in the first configuration is greater than a maximum depth of the bag in the second configuration.

Alternative Implementation 53. The bag of Alternative Implementation 1, wherein a maximum depth of the bag in the second configuration is at least about seventy-five percent less than a maximum depth of the bag in the first configuration.

Alternative Implementation 54. The bag of Alternative Implementation 1, wherein a width of the bag in the first configuration is equal to a width of the bag in the second configuration.

Alternative Implementation 55. The bag of Alternative Implementation 1, wherein the first configuration is a handbag and the second configuration is a clutch.

Alternative Implementation 56. The bag of Alternative Implementation 1, further comprising a first zipper coupled to the first opening, the first zipper being configured to selectively open and close the first side pocket.

Alternative Implementation 57. The bag of Alternative Implementation 56, further comprising a second zipper coupled to the second opening, the second zipper being configured to selectively open and close the second side pocket.

Alternative Implementation 58. The bag of Alternative Implementation 1, wherein a length of the first opening is greater than a height of the bag in the first configuration and wherein a length of the second opening is greater than the height of the bag in the first configuration.

Alternative Implementation 59. The bag of Alternative Implementation 1, wherein a length of the first opening is at least 80 percent of a height of the bag in the second configuration and wherein a length of the second opening is at least 80 percent of the height of the bag in the second configuration.

Alternative Implementation 60. The bag of Alternative Implementation 59, wherein a width of the first side pocket is at least 80 percent of a width of the bag and wherein a width of the second side pocket is at least 80 percent of the width of the bag.

Alternative Implementation 61. The bag of Alternative Implementation 1, further comprising a main opening providing access to an interior volume of the bag.

Alternative Implementation 62. The bag of Alternative Implementation 61, further comprising a flap extending from the first sidewall and being configured to fold over at least a portion of the second sidewall to aid in selectively preventing access to the interior volume of the bag.

Alternative Implementation 63. The bag of Alternative Implementation 62, further comprising a fastening device configured to aid in coupling the flap to the second sidewall.

Alternative Implementation 64. The bag of Alternative Implementation 63, wherein the fastening device includes one or more magnets, one or more clasps, one or more buckles, one or more buttons, one or more snaps, one or more straps, one or more hook and loop pads, or any combination thereof.

Alternative Implementation 65. A bag comprising: a first sidewall; a second opposing sidewall; and a foldable base coupled to the first sidewall and the second side wall, the foldable base including a first rigid panel coupled to a second rigid panel such that the foldable base is configured to fold from a generally flat configuration to a folded configuration, thereby converting the bag from an expanded configuration to a collapsed configuration.

Alternative Implementation 66. The bag of Alternative Implementation 65, further comprising a first endwall coupled to the foldable base and the first and second sidewalls at a first end of the bag and a second endwall coupled to the foldable base and the first and second sidewalls at a second opposing end of the bag.

Alternative Implementation 67. The bag of Alternative Implementation 66, wherein the coupling of the first and second endwalls to the foldable base and the first and second sidewalls includes one or more double stitches, thereby biasing the first and second endwalls towards an interior of the bag.

Alternative Implementation 68. The bag of Alternative Implementation 66, wherein the coupling of the first and second endwalls to the foldable base includes one or more double stitches, thereby biasing the first and second endwalls towards an interior of the bag.

Alternative Implementation 69. The bag of Alternative Implementation 66, wherein the coupling of the first and second endwalls to the first and second sidewalls includes one or more double stitches, thereby biasing the first and second endwalls towards an interior of the bag.

Alternative Implementation 70. The bag of Alternative Implementation 66, wherein the coupling of the first and second endwalls to the foldable base and the first and second sidewalls includes one or more top stitches, thereby biasing the first and second endwalls towards an interior of the bag.

Alternative Implementation 71. A bag convertible between an expanded configuration and a collapsed configuration, the bag comprising: a first sidewall having a first opening therein providing access to a first side pocket; a second opposing sidewall having a second opening therein providing access to a second side pocket; a foldable base coupled to the first sidewall and the second side wall, the foldable base including a first rigid panel with one or more first magnets coupled thereto, a second rigid panel with one or more second magnets coupled thereto, and a flexible strip coupling the first and second rigid panels together such that the foldable base is configured to fold in a first direction from a generally flat configuration to a folded configuration but not fold in a second opposing direction from the generally flat configuration, thereby converting the bag from the first configuration to the second configuration, the one or more first magnets and the one or more second magnets being configured to aid in maintaining the foldable base in the folded configuration and the bag in the second configuration; a first endwall coupled to (i) the foldable base via a first double stitch, (ii) the first side wall via a second double stitch, and (iii) the second sidewall via a third double stitch; and a second endwall coupled to (i) the foldable base via a fourth double stitch, (ii) the first side wall via a fifth double stitch, and (iii) the second sidewall via a sixth double stitch, wherein the first, second, third, fourth, fifth, and sixth double stitches each includes a hidden interior stitch and an exposed exterior stitch.

Alternative Implementation 72. A bag convertible between a first configuration and a second configuration, the bag comprising: a first side having a first opening therein providing access to a first side pocket; a second opposing side having a second opening therein providing access to a second side pocket; and a bi-folding base having a first rigid panel coupled to a second rigid panel such that the bi-folding base is configured to fold from a first, generally flat position to a second, folded position, thereby converting the bag from the first configuration to the second configuration.

Alternative Implementation 73. The bag of Alternative Implementation 72, responsive to the bag being in the first configuration, an interior of the bag has a first volume and responsive to the bag being in the second configuration, the interior of the bag has a second volume that is less than the first volume.

Alternative Implementation 74. The bag of Alternative Implementation 73, wherein the first volume is at least two times greater than the second volume.

Alternative Implementation 75. The bag of Alternative Implementation 72, wherein the first side pocket protrudes into the interior of the bag and is configured to store a first item therein responsive to the bag being in the first configuration or the second configuration and wherein the second side pocket protrudes into the interior of the bag and is configured to store a second item therein responsive to the bag being in the first configuration or the second configuration.

Alternative Implementation 76. The bag of Alternative Implementation 75, wherein the first item is a first of a pair of flip flops or a first of a pair of sandals and the second item is a second of the pair of flip flops or a second of the pair of sandals.

Alternative Implementation 77. The bag of Alternative Implementation 72, wherein the first opening is adjacent to a first end of the bag and the second opening is adjacent to a second opposing end of the bag.

Alternative Implementation 78. The bag of Alternative Implementation 72, wherein the first side pocket is only accessible from an exterior of the bag and wherein the second side pocket is only accessible from an exterior of the bag.

Alternative Implementation 79. The bag of Alternative Implementation 72, wherein the first rigid panel has a pair of long edges and a pair of short edges, a first of the long edges and both of the pair of short edges of the first rigid panel being coupled to the first side of the bag.

Alternative Implementation 80. The bag of Alternative Implementation 79, wherein the second rigid panel has a pair of long edges and a pair of short edges, a first of the long edges and both of the pair of short edges of the second rigid panel being coupled to the second opposing side of the bag.

Alternative Implementation 81. The bag of Alternative Implementation 80, wherein a second of the long edges of the first rigid panel is coupled to a second of the long edges of the second rigid panel along a fold line such that the base is configured to fold from the first, generally flat position to the second, folded position.

Alternative Implementation 82. The bag of Alternative Implementation 81, wherein the fold line generally corresponds to a center of the bag responsive to the bag being in the first configuration and responsive to the bag being in the second configuration.

Alternative Implementation 83. The bag of Alternative Implementation 80, responsive to the bag being in the second configuration, a bottom of the bag is formed by the first of the long edges of the first rigid panel and the first of the long edges of the second rigid panel.

Alternative Implementation 84. The bag of Alternative Implementation 72, wherein the first side includes a first sheet of material.

Alternative Implementation 85. The bag of Alternative Implementation 84, wherein the first sheet of material is leather, fabric, stretchable, or any combination thereof.

Alternative Implementation 86. The bag of Alternative Implementation 84, wherein the second side includes a second sheet of material.

Alternative Implementation 87. The bag of Alternative Implementation 86, wherein the first sheet of material and the second sheet of material are separate and distinct sheets of material.

Alternative Implementation 88. The bag of Alternative Implementation 86, wherein the first sheet of material and the second sheet of material are a monolithic sheet of material.

Alternative Implementation 89. The bag of Alternative Implementation 72, wherein the first rigid panel is coupled to the second rigid panel such that the bi-folding base is only foldable in a single direction.

Alternative Implementation 90. The bag of Alternative Implementation 72, responsive to the bag being in the second configuration, an exterior surface of the first rigid panel abuts an exterior surface of the second rigid panel.

Alternative Implementation 91. The bag of Alternative Implementation 90, responsive to the bag being in the first configuration, the exterior surface of the first rigid panel and the exterior surface of the second rigid panel are generally planar.

Alternative Implementation 92. The bag of Alternative Implementation 72, further comprising a fastener configured to aid in maintaining the bi-folding base in the second, folded position and the bag in the second configuration.

Alternative Implementation 93. The bag of Alternative Implementation 92, wherein the fastener includes a magnet, a ferromagnetic element, a clasp, a buckle, a button, a snap, a strap, hook and loop pads, a zipper, or any combination thereof.

Alternative Implementation 94. The bag of Alternative Implementation 92, wherein the fastener includes a pair of magnets coupled to the first rigid panel and a pair of ferromagnetic elements coupled to the second rigid panel.

Alternative Implementation 95. The bag of Alternative Implementation 94, responsive to the bag being in the first configuration, each of the pair of magnets and each of the pair of ferromagnetic elements is configured to rest directly on a surface as feet of the bag.

Alternative Implementation 96. The bag of Alternative Implementation 94, responsive to the bag being in the second configuration, a first of the pair of magnets is configured to magnetically couple with a first of the pair of ferromagnetic elements and a second of the pair of magnets is configured to magnetically couple with a second of the pair of ferromagnetic elements.

Alternative Implementation 97. The bag of Alternative Implementation 72, further comprising a biasing element configured to bias the bi-folding base in the first, generally flat position.

Alternative Implementation 98. The bag of Alternative Implementation 97, wherein the biasing element includes a torsion spring positioned at least partially between the first rigid panel and the second rigid panel.

Alternative Implementation 99. The bag of Alternative Implementation 72, responsive to the bi-folding base folding from the first, generally flat position to the second, folded position, a height of the bag is increased, a depth of the bag is decreased, and a width of the bag is maintained.

Alternative Implementation 100. The bag of Alternative Implementation 72, wherein a ratio of a height of the bag in the second configuration to a width of the bag is between about 5:1 and about 1.5:1.

Alternative Implementation 101. The bag of Alternative Implementation 72, wherein a ratio of a height of the bag in the second configuration to a width of the bag is between about 3:1 and about 2:1.

Alternative Implementation 102. The bag of Alternative Implementation 72, wherein a height of the bag in the first configuration is less than a height of the bag in the second configuration.

Alternative Implementation 103. The bag of Alternative Implementation 72, wherein a maximum depth of the bag in the first configuration is greater than a maximum depth of the bag in the second configuration.

Alternative Implementation 104. The bag of Alternative Implementation 72, wherein a maximum depth of the bag in the second configuration is at least about seventy-five percent less than a maximum depth of the bag in the first configuration.

Alternative Implementation 105. The bag of Alternative Implementation 72, wherein a width of the bag in the first configuration is equal to a width of the bag in the second configuration.

Alternative Implementation 106. The bag of Alternative Implementation 72, wherein the first configuration is a handbag and the second configuration is a clutch.

Alternative Implementation 107. The bag of Alternative Implementation 72, further comprising a first zipper coupled to the first opening, the first zipper being configured to selectively open and close the first side pocket.

Alternative Implementation 108. The bag of Alternative Implementation 107, further comprising a second zipper coupled to the second opening, the second zipper being configured to selectively open and close the second side pocket.

Alternative Implementation 109. The bag of Alternative Implementation 72, wherein a length of the first opening is greater than a height of the bag in the first configuration and wherein a length of the second opening is greater than the height of the bag in the first configuration.

Alternative Implementation 110. The bag of Alternative Implementation 72, wherein a length of the first opening is at least 80 percent of a height of the bag in the second configuration and wherein a length of the second opening is at least 80 percent of the height of the bag in the second configuration and wherein a width of the first side pocket is at least 80 percent of a width of the bag and wherein a width of the second side pocket is at least 80 percent of the width of the bag.

Alternative Implementation 111. The bag of Alternative Implementation 72, further comprising a main opening providing access to an interior volume of the bag.

Alternative Implementation 112. The bag of Alternative Implementation 111, wherein the main opening is generally defined by an edge of the first side and an edge of the second opposing side.

Alternative Implementation 113. The bag of Alternative Implementation 112, further comprising a main fastening device configured to selectively at least partially open and close the main opening.

Alternative Implementation 114. The bag of Alternative Implementation 113, wherein the main fastening device includes a zipper, a magnet, a clasp, a buckle, a button, a snap, a strap, hook and loop pads, or any combination thereof.

Alternative Implementation 115. A bag convertible between a first configuration and a second configuration, the bag comprising: a first side having a first opening therein providing access to a first side pocket, a length of the first opening being at least 80 percent of a height of the bag in the second configuration and a width of the first side pocket being at least 80 percent of a width of the bag; a second opposing side having a second opening therein providing access to a second side pocket, a length of the second opening being at least 80 percent of the height of the bag in the second configuration and a width of the second side pocket being at least 80 percent of the width of the bag; a bi-folding base having a first rigid panel coupled to a second rigid panel such that the bi-folding base is configured to fold from a first, generally flat position to a second, folded position, thereby converting the bag from the first configuration to the second configuration and resulting in the height of the bag being increased, a depth of the bag being decreased, and the width of the bag being maintained; and a fastener configured to aid in maintaining the bi-folding base in the second, folded position and the bag in the second configuration.

Alternative Implementation 116. The bag of Alternative Implementation 115, further comprising a biasing element configured to bias the bi-folding base in the first, generally flat position, the biasing element including a torsion spring positioned at least partially between the first rigid panel and the second rigid panel.

Alternative Implementation 117. The bag of Alternative Implementation 115, wherein the first rigid panel is coupled to the second rigid panel such that the bi-folding base is only foldable in a single direction.

Alternative Implementation 118. The bag of Alternative Implementation 115, responsive to the bag being in the first configuration, an interior of the bag has a first volume and responsive to the bag being in the second configuration, the interior of the bag has a second volume that is less than the first volume.

Alternative Implementation 119. The bag of Alternative Implementation 115, wherein the fastener includes a pair of magnets coupled to the first rigid panel and a pair of ferromagnetic elements coupled to the second rigid panel.

Alternative Implementation 120. The bag of Alternative Implementation 119, responsive to the bag being in the first configuration, each of the pair of magnets and each of the pair of ferromagnetic elements is configured to rest directly on a surface as feet of the bag and responsive to the bag being in the second configuration, a first of the pair of magnets is configured to magnetically couple with a first of the pair of ferromagnetic elements and a second of the pair of magnets is configured to magnetically couple with a second of the pair of ferromagnetic elements.

Alternative Implementation 121. The bag of Alternative Implementation 115, wherein a ratio of the height of the bag in the second configuration to a width of the first rigid panel is between about 3:1 and about 2:1.

Alternative Implementation 122. A storage bag comprising: a pair of sidewalls each having an elongated pocket overlaying a majority portion of each respective sidewall; a foldable base between the sidewalls at one end thereof with an opening at the other end thereof leading to an interior cavity within the storage bag, wherein outside surface portions of the foldable base abut one another in a folded configuration and are generally coplanar with one another in an expanded configuration such that converting the storage bag from the folded configuration to the expanded configuration causes the interior cavity to expand to reveal a volumetric cavity defined by the sidewalls and the foldable base, and converting the storage bag from the expanded configuration to the folded configuration collapses the interior volume by elongating an overall height of the storage bag as the outside surface portions of the foldable base are urged toward one another.

Alternative Implementation 123. The bag of Alternative Implementation 122, wherein the foldable base is a bi-folding base.

It is expressly contemplated that one or more elements from any of the above alternative implementations can be combined with one more elements from one or more others of the alternative implementations to provide additional alternative implementations.

While the present disclosure has been described with reference to one or more particular embodiments and implementations, those skilled in the art will recognize that many changes may be made thereto without departing from the spirit and scope of the present disclosure. Each of these embodiments and implementations and obvious variations thereof is contemplated as falling within the spirit and scope of the present disclosure, which is set forth in the claims that follow.

What is claimed is:

1. A bag comprising:

a first sidewall;

a second opposing sidewall; and a foldable base coupled to the first sidewall and the second side wall, the foldable base including (i) a sheet of material, (ii) a first rigid panel, (iii) a second rigid panel, (iv) one or more fasteners, and (v) a strip, the first rigid panel being coupled to the second rigid panel such that the foldable base is configured to fold from a generally flat configuration to a folded configuration, thereby converting the bag from an expanded configuration to a collapsed configuration, responsive to the bag being in the collapsed configuration, the one or more fasteners are configured to aid in maintaining the foldable base in the folded configuration and the bag in the collapsed configuration, the strip aiding in coupling the first rigid panel to the second rigid panel, the strip permitting the foldable base to fold in a first direction and aiding in preventing the foldable base from folding in a second opposing direction.

2. The bag of claim 1, wherein the one or more fasteners includes a magnet, a ferromagnetic element, a clasp, a buckle, a button, a snap, a strap, hook and loop pads, a zipper track and zipper pull, or any combination thereof.

3. The bag of claim 1, wherein the one or more fasteners is a zipper track and zipper pull.

4. The bag of claim 1, wherein the one or more fasteners includes one or more snaps.

5. The bag of claim 1, wherein the sheet of material is coupled to the first rigid panel and the second rigid panel such that the sheet aids in coupling the first rigid panel to the second rigid panel.

6. The bag of claim 1, responsive to the foldable base folding from the generally flat configuration to the folded configuration, a height of the bag is increased, a depth of the bag is decreased, and a width of the bag is maintained.

7. A bag comprising:

a first sidewall;

a second opposing sidewall;

a foldable base coupled to the first sidewall and the second side wall, the foldable base including (i) a sheet of material, (ii) a first rigid panel, (iii) a second rigid panel, and (iv) one or more fasteners, the first rigid panel being coupled to the second rigid panel such that the foldable base is configured to fold from a generally flat configuration to a folded configuration, thereby converting the bag from an expanded configuration to a collapsed configuration, responsive to the bag being in the collapsed configuration, the one or more fasteners are configured to aid in maintaining the foldable base in the folded configuration and the bag in the collapsed configuration; and a first endwall coupled to the foldable base and the first and second sidewalls at a first end of the bag and a second endwall coupled to the foldable base and the first and second sidewalls at a second opposing end of the bag, the coupling of the first and second endwalls to the foldable base and the first and second sidewalls including one or more double stitches, each of the one or more double stitches comprising a hidden interior stitch and an exposed exterior stitch, each of the hidden interior stitches being located a first distance from a corresponding outer edge of the bag and each of the exposed exterior stitches being located a second distance from a corresponding outer edge of the bag, wherein the first distance is between about 0.03125 inches and about 0.125 inches and the second distance is between about 0.125 inches and about 0.5 inches.

8. The bag of claim 1, wherein a thickness of each of the first and second rigid panels is between about 0.1 inches and about 0.4 inches.

9. The bag of claim 1, wherein the first side wall includes a first opening therein to provide access to a first side pocket of the bag and the second side wall includes a second opening therein to provide access to a second side pocket of the bag.

10. The bag of claim 9, wherein a length of the first opening is at least 80 percent of a height of the bag in the collapsed configuration and wherein a length of the second opening is at least 80 percent of the height of the bag in the collapsed configuration.

11. The bag of claim 10, wherein a width of the first side pocket is at least 80 percent of a width of the bag and wherein a width of the second side pocket is at least 80 percent of the width of the bag.

12. The bag of claim 1, wherein a ratio of a height of the bag in the collapsed configuration to a width of the bag is between about 5:1 and about 1.5:1.

13. The bag of claim 1, wherein a height of the bag in the expanded configuration is less than a height of the bag in the collapsed configuration.

14. The bag of claim 1, further comprising:

a first endwall coupled to the foldable base and the first and second sidewalls at a first end of the bag;

a second endwall coupled to the foldable base and the first and second sidewalls at a second opposing end of the bag;

a first endwall fastener coupled to the first endwall to selectively aid in biasing the first endwall into an interior cavity of the bag; and a second endwall fastener coupled to the second endwall to selectively aid in biasing the second endwall into the interior cavity of the bag.

15. A bag comprising:

a first sidewall;

a second opposing sidewall; and a foldable base coupled to the first sidewall and the second side wall, the foldable base including (i) a sheet of material, (ii) a first rigid panel, (iii) a second rigid panel, and (iv) one or more fasteners, the first rigid panel being coupled to the second rigid panel such that the foldable base is configured to fold from a generally flat configuration to a folded configuration, thereby converting the bag from an expanded configuration to a collapsed configuration, responsive to the bag being in the collapsed configuration, the one or more fasteners are configured to aid in maintaining the foldable base in the folded configuration and the bag in the collapsed configuration, wherein the one or more fasteners are positioned between the sheet of material and the first rigid panel and/or the second rigid panel such that the one or more fasteners are concealed by the sheet of material.

16. The bag of claim 15, further comprising:

a first endwall coupled to the foldable base and the first and second sidewalls at a first end of the bag;

a second endwall coupled to the foldable base and the first and second sidewalls at a second opposing end of the bag;

a first endwall fastener coupled to the first endwall to selectively aid in biasing the first endwall into an interior cavity of the bag; and a second endwall fastener coupled to the second endwall to selectively aid in biasing the second endwall into the interior cavity of the bag.

17. The bag of claim 15, wherein the sheet of material is coupled to the first rigid panel and the second rigid panel such that the sheet aids in coupling the first rigid panel to the second rigid panel.

18. The bag of claim 15, wherein the first side wall includes a first opening therein to provide access to a first side pocket of the bag and the second side wall includes a second opening therein to provide access to a second side pocket of the bag, and wherein a length of the first opening is at least 80 percent of a height of the bag in the collapsed configuration and wherein a length of the second opening is at least 80 percent of the height of the bag in the collapsed configuration, and wherein a width of the first side pocket is at least 80 percent of a width of the bag and wherein a width of the second side pocket is at least 80 percent of the width of the bag.

19. The bag of claim 18, wherein a ratio of a height of the bag in the collapsed configuration to a width of the bag is between about 5:1 and about 1.5:1 and responsive to the foldable base folding from the generally flat configuration to the folded configuration, a height of the bag is increased, a depth of the bag is decreased, and a width of the bag is maintained.

20. The bag of claim 7, further comprising a first endwall fastener coupled to the first endwall to selectively aid in biasing the first endwall into an interior cavity of the bag and a second endwall fastener coupled to the second endwall to selectively aid in biasing the second endwall into the interior cavity of the bag.

* * * * *